United States Patent [19]

Anthony et al.

[11] Patent Number: 5,024,132

[45] Date of Patent: Jun. 18, 1991

[54] ELECTRONIC TUNER FOR A MUSICAL INSTRUMENT

[75] Inventors: Michael Anthony, 920 Cloverview, Glendora, Calif. 91740; Craig A. Ohler, Brea, Calif.; Arnold Christensen, Costa Mesa, Calif.

[73] Assignee: Michael Anthony, Glendora, Calif.

[21] Appl. No.: 441,711

[22] Filed: Nov. 27, 1989

[51] Int. Cl.[5] ..... G10D 3/14; G10G 7/02

[52] U.S. Cl. ..... 84/312 R; 84/455

[58] Field of Search ..... 84/454, 455, 312 R

[56] References Cited

U.S. PATENT DOCUMENTS

| | | | |
|---|---|---|---|
| 4,252,048 | 2/1981 | Pogoda | 84/454 |
| 4,297,938 | 11/1981 | Kirby | 84/455 |
| 4,312,044 | 1/1982 | Baba | 364/554 |
| 4,338,846 | 7/1982 | Pagoda | 84/1.24 |
| 4,354,418 | 10/1982 | Moravec et al. | 84/454 |
| 4,434,697 | 3/1984 | Roses | 364/554 |
| 4,523,506 | 6/1985 | Holliman | 84/454 |
| 4,688,464 | 8/1987 | Gibson | 84/454 |
| 4,732,071 | 3/1988 | Deutsch | 84/454 |
| 4,803,908 | 2/1989 | Skinn et al. | 84/454 |

FOREIGN PATENT DOCUMENTS

| | | | |
|---|---|---|---|
| 2904912 | 8/1980 | Fed. Rep. of Germany | 84/DIG. 18 |
| 55-112530 | 8/1980 | Japan | 84/DIG. 18 |

*Primary Examiner*—L. T. Hix
*Assistant Examiner*—Jae N. Noh
*Attorney, Agent, or Firm*—Poms, Smith, Lande & Rose

[57] ABSTRACT

An electronic tuner generates a pulse train signal from an analog signal transduced from vibrations on a selected one of several strings of a musical instrument. The pulse train signal has a plurality of successive pulses, each of the pulses having a pulse width which may vary between successive pulses. Two of the pulses have a longest pulse width of all pulses in the pulse string are identified. The tuner then computes a current fundamental frequency on the selected string as a function of a ratio between a numerical count of the pulses occurring between these two pulses, the count including one of these pulses, and a sum of the pulse width of each of the pulses included in the count. The two of the pulses have a longest pulse width of all pulses in the pulse string. A difference signal is developed as a function of a difference between the current fundamental frequency and a known in-tune frequency associated with the selected string being tuned. The difference signal may then be used to visually display the difference whereby the selected one of the strings can be tuned to minimize the difference.

23 Claims, 7 Drawing Sheets

FIG. 3
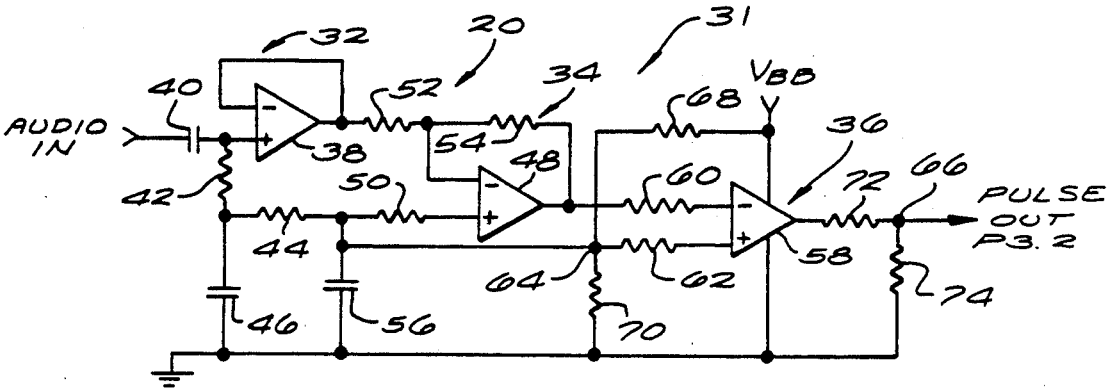
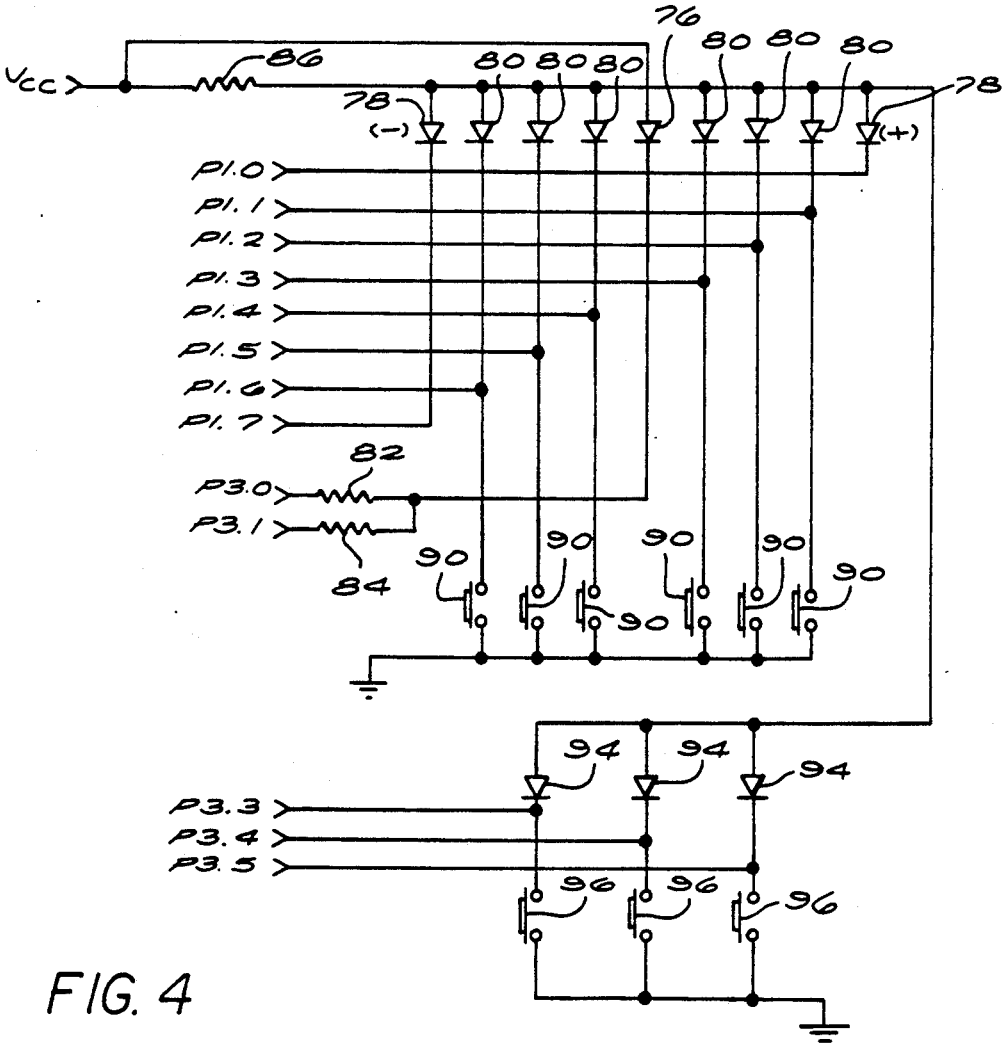
FIG. 4

FIG. 5
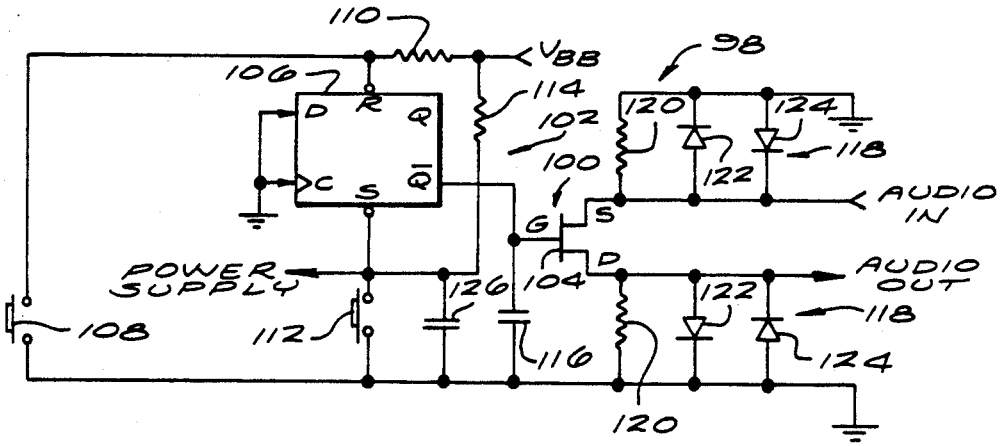
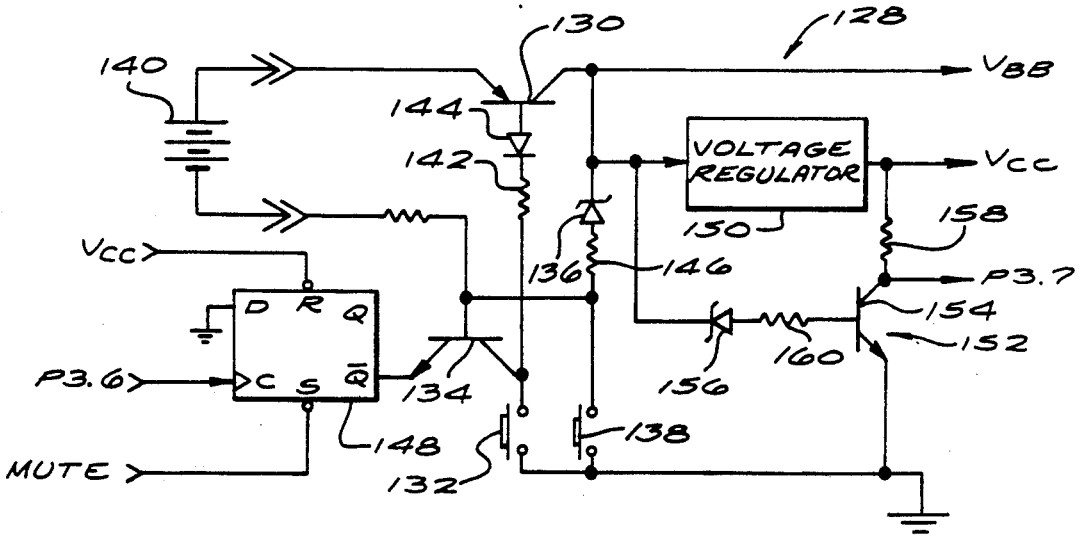
FIG. 6

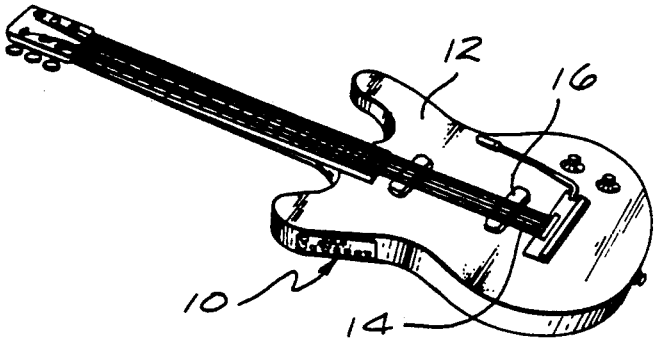
FIG. 7
FIG. 8
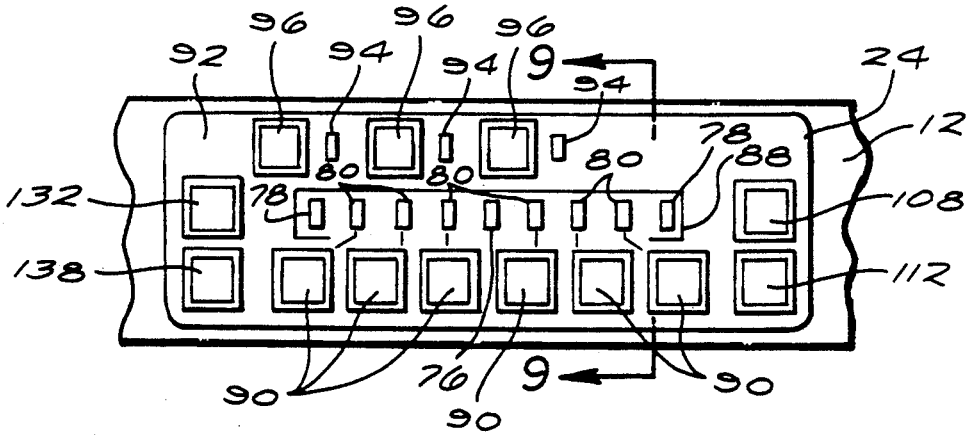
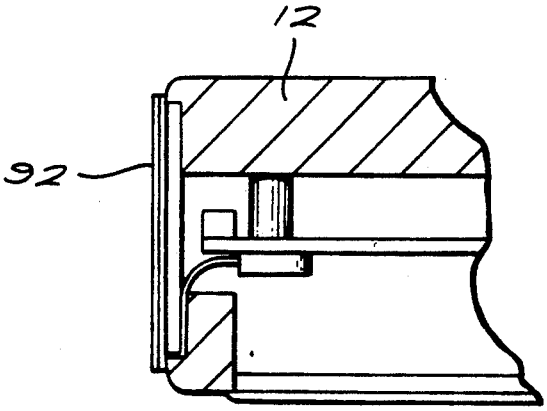
FIG. 9

FIG. 11
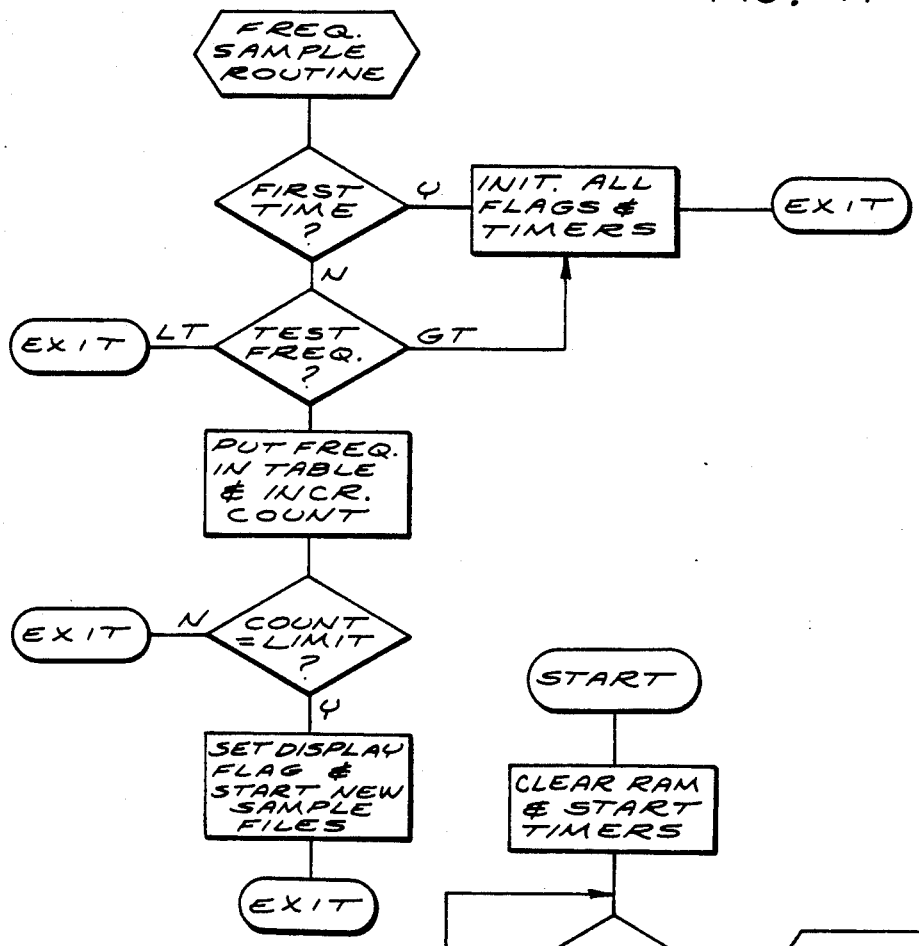
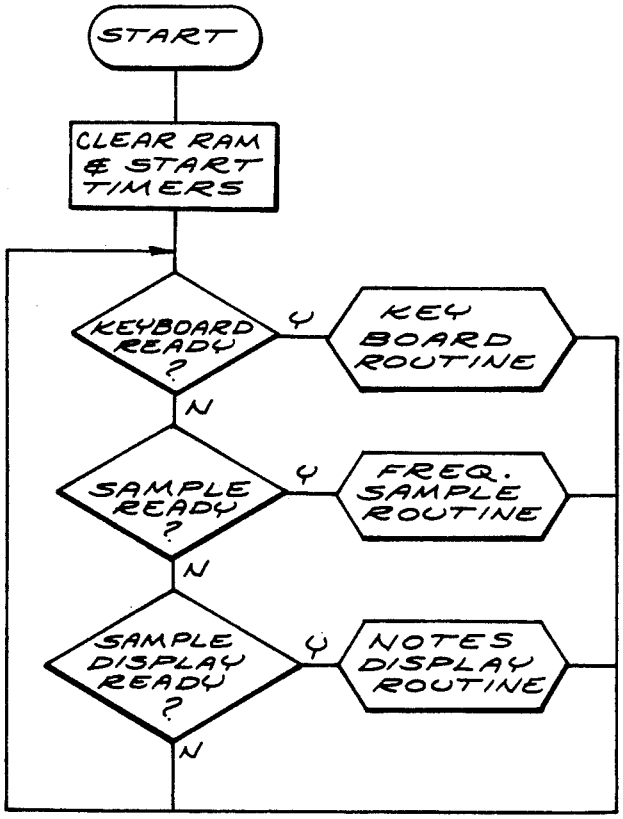
FIG. 10

FIG. 12
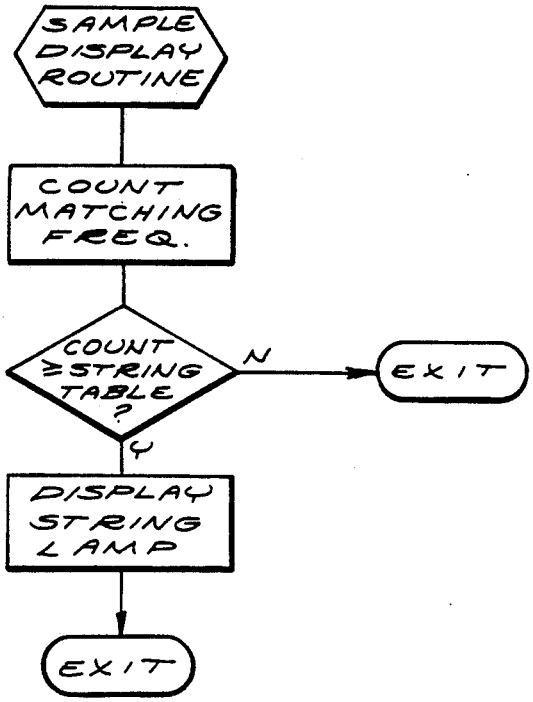
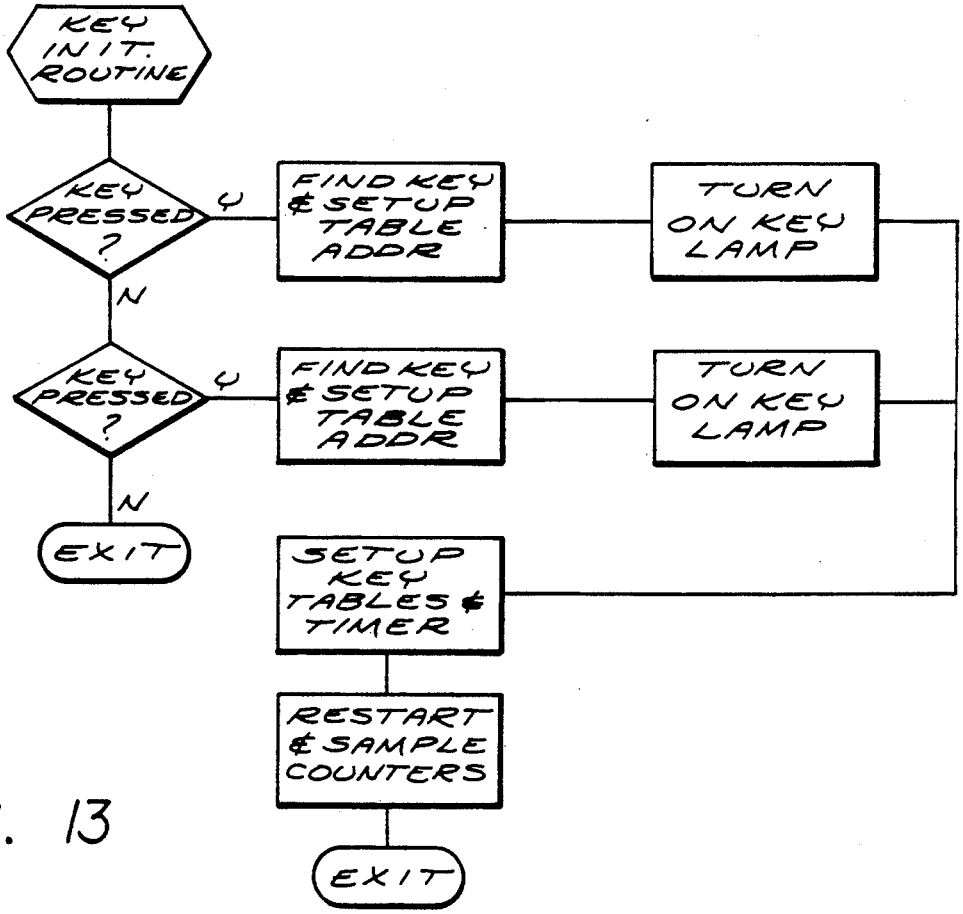
FIG. 13

ELECTRONIC TUNER FOR A MUSICAL INSTRUMENT

FIELD OF THE INVENTION

The present invention relates generally to an electronic tuner for a musical instrument and more specifically to such an apparatus particularly adapted for use with electric stringed instruments.

BACKGROUND OF THE INVENTION

Tuning of a musical instrument traditionally involves a first player listening to a reference note, which may be the note sounded by one or more other players of an ensemble, and adjusting the first player's instrument until the corresponding note is consonant with the reference note. Detection of correct intonation involves a subconscious comparison of the two notes until the combination of the two notes are in tune with each other.

The determination of correct intonation is a skill which is acquired as part of the player's basic musicianship training and which is acquired only after long hours of practice. As with many acquired skills, the accuracy of the intonation which results is a combination of the inherent talent of the performer and the diligence with which the task is pursued.

There have been numerous prior art attempts to provide electromechanical, mechanical or electronic apparatus for use as tuning aids which can detect the presence or absence of the desired intonation characteristics. Musicians are greatly assisted by the use of such tuning aids. For example, professional players can benefit from comparison of their intonation with the theoretically perfect standard.

For example, one class of prior art tuning aids are frequency meters which employ period measuring circuits to detect a zero crossing of the output of a suitable transducer. The inverse of the period may then be computed and the frequency of the tone thus determined and displays. Such instruments can give quite accurate results, but suffer from a disadvantage and limitation that the displayed value has little meaning to a musician who thinks not in terms of physical units but rather in terms of subjective cycle acoustic phenomenon such as pitch. A further disadvantage and limitation of such devices is that the detected waveform contains not only the fundamental frequency but also harmonic frequencies of the fundamental frequency. Therefore, the period measuring circuit may develop an error when encountering zero crossings of the transducer output which are caused by the summation of the harmonic frequencies in the fundamental frequency.

For example, Moravec, et al., U.S. Pat. No. 4,354,418, disclose an automatic note analyzer which computes the fundamental frequency from the time period of the output signal from a transducer. A data count is obtained by counting the number of CPU clock pulses counted within a measurement period extending over P consecutive cycles of the input signal, or data count equals P times $C_1$, where $C_1$ equals the period of the input signal. The measurement period should extend for at least two cycles of the input signal. A number of sequential data counts similar to the first data count are then taken. These data counts are then analyzed to determine whether a consistent pattern can be found. In particular, N separate data counts which are equal to one another, within a tolerance of about 3%, are attempted to be found. Once N consistent data counts are found, then a variable K is set equal to the sum of these N data counts. Thus, K is a variable which corresponds to the sum of a selected number of N consistent data counts. Since the time period $C_1$ is not actually a constant value, the variable K is a function of three variables: (1) the time delay between adjacent zero crossings, (2) the duration of the measurement period of a single data count in terms of the number of zero crossings which occur between the starting and stopping of the counter, and (3) the number of data counts which are summed to determine K.

Once an initial value for the variable K has been determined, K is then normalized to place it within a desired range. The normalization is accomplished by multiplying or dividing as necessary by factors of 2 until it falls within the desired range. For example, if the value of K is lower than the minimum accepted value, K is doubled. If K is still below the minimum acceptable value then it is doubled again. Conversely, if K is greater than the maximum allowed value then the value of K is divided by 2 and so forth. In this way, the variable K is normalized to fall within the desired range. Of course this desired range is the expected value.

The normalized value of K is then averaged with previous calculated values of K to smooth out fluctuations. For example, the current value of K may be summed with 15 immediately preceding values of K and the summed divided by 16 to recursively generate an average. The variable T is then equal to the recursively averaged K divided by N. T is a measure of the expected data count for measurement periods lasting over P cycles of the input signal. The variable T is used as a target signal to define a window which is used to screen incoming data to ascertain whether that incoming data is consistent with previously measured values of the data count and thereby to screen out erroneous measurements.

In addition, the recursive average of K is used to determine the musical note corresponding to the input signal. In particular, the recursively averaged K is compared with the look-up table which lists values for the recursively averaged K at the halfway points between adjacent semi-tone. In this way, the semitone closest to the recursively averaged K is determined. In addition, the difference between recursively averaged K and the table entry for the nearest semitone is determined as the fractional deviation of the recursively averaged K from the nearest semitone in cents.

A disadvantage and limitation of the apparatus disclosed in Moravec, et al., is that the computations to compute K or frequency appear to be sensitive to large amplitude harmonics of the fundamental frequency. In calculating K, it is assumed that interrupts will occur at the fundamental frequency of the output signal from the transducer. However, relatively large amplitude harmonics which occur will cause substantial measurement errors in this fundamental frequency. Since this error will not always be in a factor of two, the calculated fundamental frequency may be in gross error.

Other types of electronic apparatus use a comparison of a known frequency standard, such as the output frequency of a crystal controlled oscillator, with the frequency of the unknown signal being measured. Both signals are electronically conditioned to provide a substantially pure sine waveform before they are applied to the vertical and horizontal deflection plates of a cathode ray tube oscilloscope. When the notes are identical in frequency, a circular "Lissajous" pattern is formed on the screen. When sharp or flat the Lissajous pattern will appear to rotate at a rate which is determined by the magnitude of the departure of the frequency of the unknown signal from the frequency of the reference signal.

A similar oscilloscope based device employs an oscilloscope having a known horizontal sweep rate. The horizontal sweep rate is then compared with an unknown signal input. When the signal is properly synchronized, a stationary waveform will appear on the oscilloscope screen. When the note represented by the unknown signal is slightly too sharp, the pattern appears to move to the left. Conversely, when the note is slightly too flat, the pattern appears to move to the right.

The indications available from these oscilloscope based instruments are ambiguous to the user in that the degree of the inaccuracy of the incoming pitch cannot be readily be determined. In the case of the first type of oscilloscope display described, it is difficult to determine both polarity (sharp or flat) and the degree of departure from the theoretical perfect intonation. Since the user is unable to determine the needed information by merely viewing the oscilloscope screen, he can never be absolutely sure of his intonation. Moreover, as a training aid, these devices are disadvantageously limited in that they do not readily indicate in which direction the pitch of the unknown signal must be varied in order to bring it close to the theoretically correct pitch.

To make the displays more readable, LED diodes in a linear array may be used. For example, in Roses. U.S. Pat. No. 4,434,697, there is disclosed a tuning device wherein an acoustic signal is used to develop an electrical input signal. The input signal is applied to a plurality of low pass filters. The signal from the lowest cut-off frequency low pass filter which passes the signal is utilized. After filtering, a high frequency clock count is obtained to determine the time period of the signal chosen. An entry and a look-up table in computer memory is selected as being the closest to determine time period. An LED display is used to determine visually if the time period of chosen signal is above or below the selected entry in the look-up table.

SUMMARY OF THE INVENTION

According to the present invention, an electronic tuner generates a pulse train signal from an analog signal transduced from vibrations on a selected one of several strings of a musical instrument. The pulse train signal has a plurality of successive pulses, each of the pulses having a pulse width which may vary between successive pulses. Two of the pulses have a longest pulse width of all pulses in the pulse string are identified. The tuner then computes a current fundamental frequency on the selected string as a function of a ratio between a numerical count of the pulses occurring between these two pulses, the count including one of these pulses, and a sum of the pulse width of each of the pulses included in the count. The two of the pulses have a longest pulse width of all pulses in the pulse string. A difference signal is developed as a function of a difference between the current fundamental frequency and a known in-tune frequency associated with the selected string being tuned. The difference signal may then be used to visually display the difference whereby the selected one of the strings can be tuned to minimize the difference.

These an other objects, advantages and features of the present invention will become more apparent to those skilled in the art from a study of the following description of an exemplary preferred embodiment when read in conjunction with the attached drawings and appended claims.

BRIEF DESCRIPTION OF THE DRAWINGS

FIG. 3 is a circuit diagram of the pulse generator of FIG. 1;

FIG. 4 is a circuit diagram of the select and display function of FIG. 1;

FIG. 5 is a circuit diagram of the mute function of FIG. 1;

FIG. 6 is a more detailed circuit diagram of the power supply shown in FIG. 1;

FIG. 7 illustrates one use of the electronic tuner of the present invention;

FIG. 8 is an enlarged detail of a portion of FIG. 7;

FIG. 9 is a cross-sectional view, broken away, taken along line 9—9 of FIG. 8; and FIGS. 10–15 are flow charts illustrating the sequence of operations executed by the CPU of FIG. 1.

DESCRIPTION OF AN EXEMPLARY PREFERRED EMBODIMENT

Figure 1:
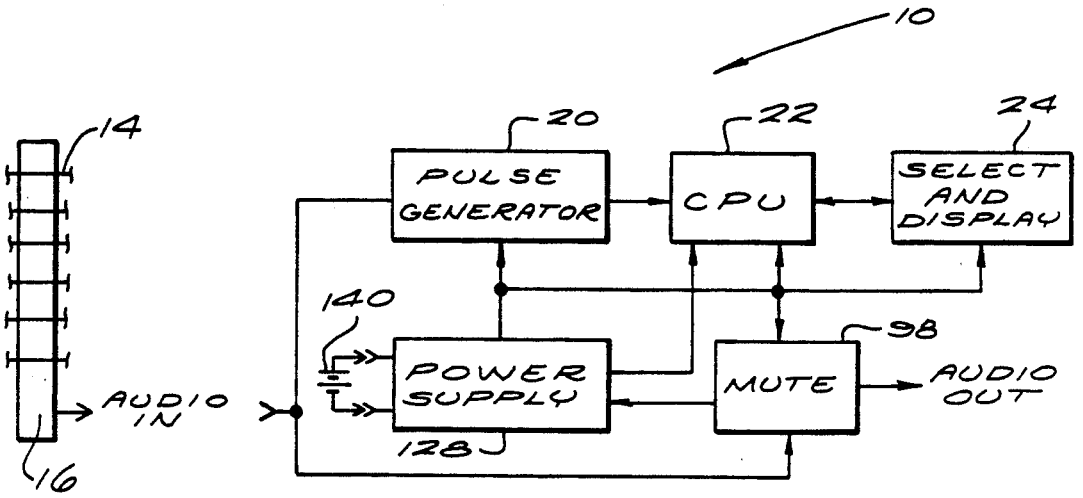
FIG. 1 is a schematic block diagram of an electronic tuner constructed according to the principles of the present invention.

Referring now to FIG. 1, there is shown an electronic tuner 10 constructed according to the principles of the present invention. The electronic tuner 10 is particularly useful in conjunction with a musical instrument 12 (as best seen in FIG. 7) having plurality of strings 14. Each of the strings 14 is vibratable at a different fundamental frequency and at an integer multiple harmonic frequencies of the fundamental frequency. The instrument 12 includes means 16 for transducing vibrations on each of the strings 12 into an electrical analog signal. As is known, the instrument 12 also includes means 18 for tensioning each of the strings to tune the fundamental frequency to an in tune frequency associated with each of the strings 14. The electrical analog signal developed by the transducer 16 is generally represented in the Drawing by the audio input signal applied to the electronic tuner 10, as best seen in FIG. 1.

The electronic tuner 10 includes means 20 for generating a pulse train signal from the analog signal developed by the transducer 16, means 22 for computing the current fundamental frequency on one of the strings 14 and further for determining the difference between the current fundamental frequency and the in-tune frequency associated with the selected string 14, and means 24 for visually displaying the difference whereby the selected one of the strings 14 can be tuned to minimize the difference.

The pulse train signal developed by generating means 20 has a plurality of successive pulses. Each of the pulses has a pulse width which may vary between successive pulses. The pulse train signal is developed from an analog signal which is transduced from vibrations on a selected one of the strings 14.

Computing means 22, hereinafter also referred to as CPU 22, computes the current fundamental frequency on the selected one of the strings 14 as a function of a ratio between a numerical count of the pulses occurring between at least two of the pulses and including one of those two pulses and a sum of the pulse width of each of the pulses included in the count. The pulses are selected to have the longest pulse width of the pulses in the pulse string. Computing means 22 further develops a difference signal as a function of the difference between the current fundamental frequency and the in tune frequency associated with the selected one of the strings. The display means 24 is responsive to this difference signal to generate its display.

Figure 2:
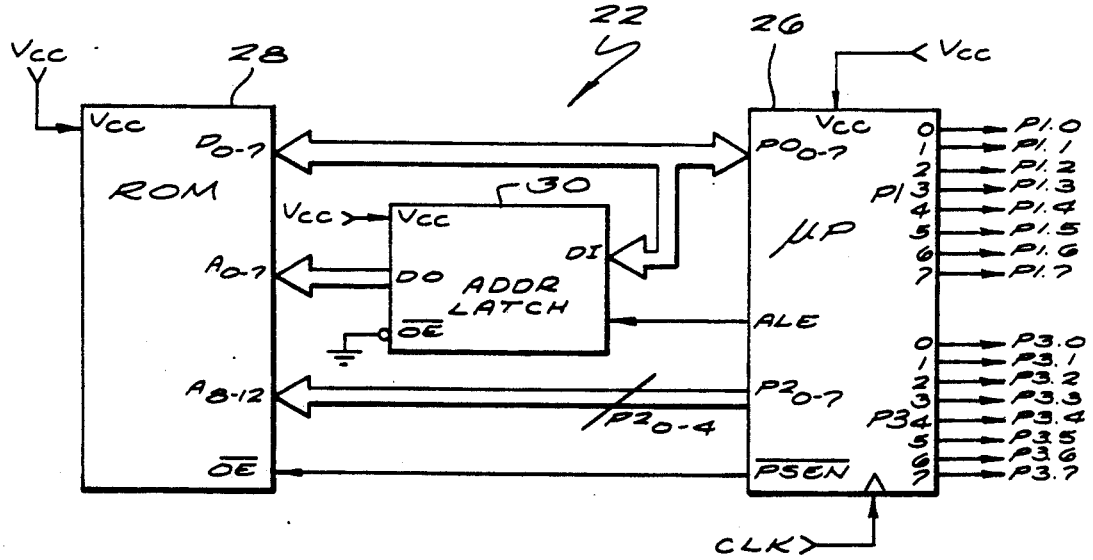
FIG. 2 is a schematic block diagram of the CPU shown in FIG. 1.
Figure 14:
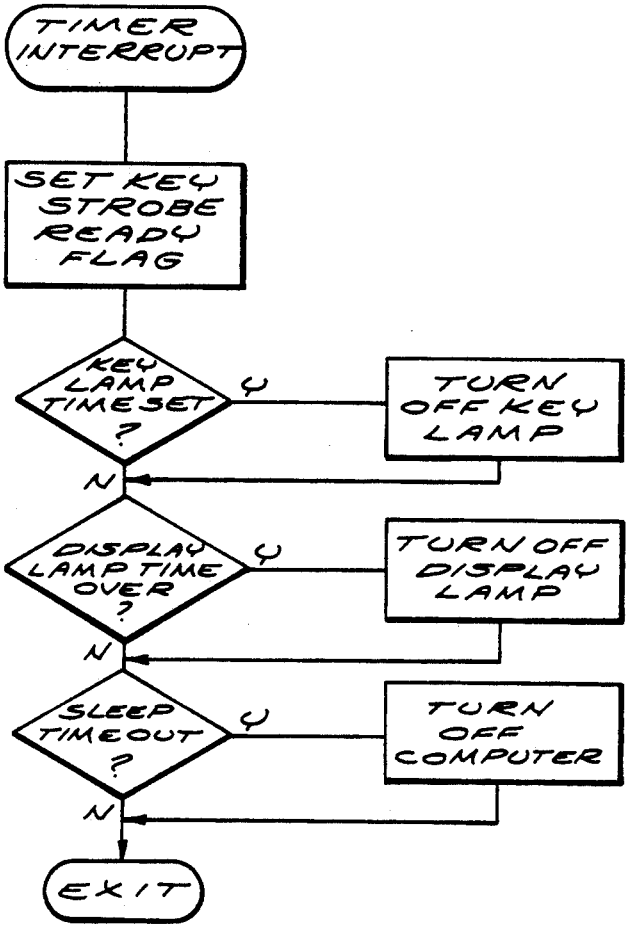
Figure 15:
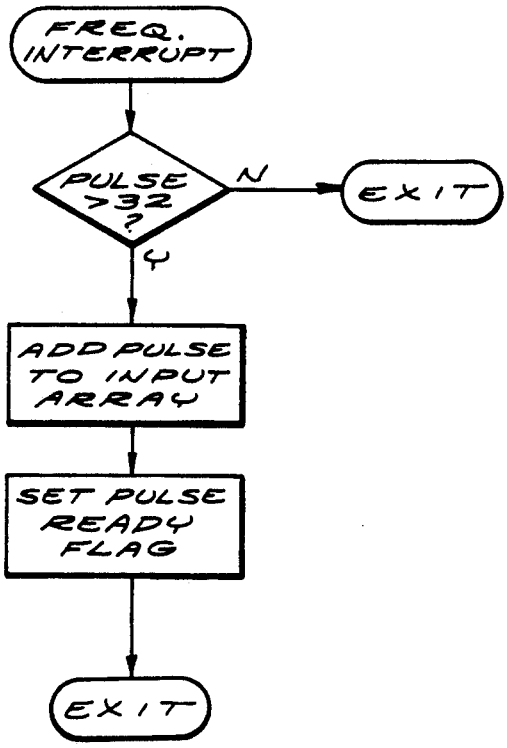

With further reference to FIG. 2, the CPU 22 includes a microprocessor 26. The microprocessor 26 has a plurality of I/O ports represented by a P0, P1, P2, and P3. At least two of the ports, P1 and P3, have a plurality of parallel pins, P1.0–P1.7 and P3.0–P3.7. The pulse train is applied to one of the pins, and in particular P3.2. The difference signal is developed at other ones of the pins, and in particular, as herein described below, at all pins in port 1, P1, and further at pins P3.0 and P3.1 at port P3.

The instruction set, attached hereto as Appendix A, is stored in a ROM 28 which forms part of the CPU 22. The ROM 28 is connected to the microprocessor 26 in a known manner. Microprocessor 26 may be a 8051 processor wherein one I/O port, P0, transmits both data and addresses. Accordingly, an address latch 30 is also provided.

Referring further to FIG. 3, pulse generator means 20 is a waveshaping circuit 31 which develops each of the pulses to have a leading edge corresponding to a positive slope zero crossing of the analog signal and a trailing edge corresponding to a negative slope zero crossing of the analog signal. The pulse width of each one of the pulses extends between the leading edge of one pulse and the leading edge of the next successive one of the pulses. The waveshaping circuit 31 includes a unity gain noninverting first amplifier circuit 32 an inverting second amplifier circuit 34 and an inverting high voltage gain third amplifier circuit 36. The first amplifier circuit 32 has an input to which the audio input analog signal is applied and an output. The second amplifier circuit has an input electrically coupled to the output of the first amplifier circuit 32 and an output. The third amplifier circuit 36 has an input electrically coupled to the output of the second amplifier circuit 34 and an output at which the pulse out pulse train signal is developed.

More particularly, the first amplifier circuit 32 includes an operational amplifier 38, a DC blocking capacitor 40, a first bias resistor 42, a second bias resistor 44 and a high frequency shunt capacitor 46. The operational amplifier 38 has an inverting input, a noninverting input and an output. The amplifier 38 has its inverting input electrically coupled to its output. The output of the amplifier 38 forms the output of the first amplifier circuit 32. The DC blocking capacitor 46 has a first plate electrically coupled to the noninverting input of the amplifier 38 and a second plate which the audio input analog signal is applied. The first bias resistor is also coupled to the noninverting input of the amplifier 38. The second bias resistor is coupled in series to the first bias resistor and is adapted to have a first bias potential applied thereto. The high frequency shunt capacitor 46 has a first plate electrically coupled to each of the first resistor 42 and the second resistor 44 at a common node and a second plate coupled to ground potential.

The second amplifier circuit 34 includes an operational amplifier 48, a first bias resistor 50, an input resistor 52, a feedback resistor 54 and a high frequency shunt capacitor 56. The output of amplifier 48 forms the output of the second amplifier circuit 34. The input resistor 52 is coupled between the output of the first amplifier circuit 32 and the inverting input of the amplifier 48. The feedback resistor is electrically coupled between the inverting input and output of the amplifier 48. The first bias resistor is coupled to the noninverting input of amplifier 48 and adapted to have the first bias potential applied thereto. The high frequency shunt capacitor 56 has a first plate electrically coupled to the node where the bias potential is applied to the bias resistor 50 and a second plate coupled to ground potential.

Third amplifier circuit 36 includes an operational amplifier 58, a first input resistor 60, a second input resistor 62, a first voltage divider 64 and a second voltage divider 66. The first input resistor 60 is electrically coupled between the output of the second amplifier circuit 34 and the inverting input of the amplifier 58. The second input resistor is electrically coupled to the noninverting input of the amplifier 58 and is adapted to have the first bias potential applied thereto. The first bias potential is developed by the first voltage divider 64. Accordingly, the first voltage divider 64 has a resistor 68 to which a second bias voltage, $V_{bb}$, is applied and a resistor 70 serially coupled between the resistor 68 and ground potential. The first bias potential is developed at a node 64 between the resistor 68 and the resistor 70. The second input resistor 62 is further electrically coupled to the node between the resistors 68 and 70. The second voltage divider 66 has a resistor 72 coupled to the output of the amplifier 58 and a resistor 74 serially coupled between the resistor 72 and ground potential. The output of the third amplifier circuit 36 is that there is a node between the resistor 72 and 74. Furthermore, the second bias potential $V_{bb}$, is applied to an upper bias voltage input of the amplifier 58. The lower bias voltage input of the amplifier 58 is coupled to ground potential. Thus, the signal applied to the inputs of the amplifier 58 cause the output of the amplifier 58 to switch between ground potential and potential $V_{bb}$. The voltage divider 66, in a preferred embodiment of the present invention reduces maximum voltage to one half if each of resistors 72 and 74 are equal. For example, each of resistors 72 and 74 may be 2.2k ohms. In the preferred embodiment of the present invention, capacitor 40, capacitor 46 and capacitor 56 are each 0.1 microfarad capacitors. Resistors 42 and 44 are 100k ohms resistors. Resistors 50 and 52 are 10k ohms resistors and resistor 54 is a 470k ohms. Resistors 68 and 70 of first voltage divider 64 are each 4.7k. Input resistors 60 and 62 of the third amplifier 58 are also 10k resistors.

Referring now to FIG. 4, there is shown a circuit diagram of the displaying means 24 of FIG. 1. Displaying means 24 includes a first LED 76, a pair of second LEDs 78 and a plurality of third LEDs 80. The anode of the first LED 76 is coupled to the logic level bias potential, $V_{cc}$, and its cathode is coupled to pin P3.0 and P3.3 of the I/O port, P3, of the microprocessor 26 through a resistor 82 and a resistor 84, respectively. In a preferred embodiment of the present invention, resistors 82 and 82 have a substantially equivalent resistance. For example, of each of resistors 82 and 84 may be 680 ohms.

The anode of each of the pair of second LED 78, and the anode of each of the plurality of third diodes 80 are commonly connected to the logic levels bias potential, $V_{cc}$, through a resistor 86. In a preferred embodiment of the present invention, the resistance of resistor 86 is substantially equivalent to the resistance of each of the resistors 82 and 84. Again, the resistance of resistor 86 may be 680 ohms. The cathode of a first one of LED 78 and a cathode of a second one of LED 78 are coupled to the I/O port P1 through pin P1.0 and pin P1.7, respectively. Similarly, the cathode of each of the third LEDs 80 are coupled to the first port P1 of the microprocessor 26 at pins P1.1–P1.6, as best seen in FIG. 4.

As hereinabove described, the difference signal is developed at the pins of the microprocessor 26 through each cathode of LED 76, second LED 78 and third LED 80, the hereinabove described pins being those pins at which the difference signal is developed. The first LED 76 is illuminated when the difference is substantially illuminated. Accordingly, the difference signal is a plurality of parallel bits corresponding to the above-described pins. One of the first LED 76, second LED 78 and third LED 80 are illuminated in response to a state change in a corresponding one of those bits. For example, when the difference is substantially minimized, pins P3.0 and P3.1 go low developing a current through the first LED 76 and each of the resistor 82 and the resistor 84. When a magnitude of the difference exceeds a pre-selected magnitude, one of pins P1.0 and P1.7 go low. The difference signal thereby illuminates one of the second LED 78. One of the second LED 78 indicates a negative (−) polarity and a second one of the second LED 78 indicates a positive (+) polarity of the difference, as generally indicated in FIG. 4. When the magnitude of the difference is above a pre-selected increment but less than the pre-selected magnitude, the difference signal illuminates one of the third LED 80. Accordingly, one of pins P1.1–P1.6 goes low to develop a current through the corresponding one of the third LED 80. Also, first ones of said third LEDs indicate a negative (−) polarity and second ones of the third LEDs indicate a positive (+) of the difference, again as indicated in FIG. 4.

With further reference to FIG. 8, the first LED 76, the second LED 78 and third LED 80 are disposed in a linear array 88. The first LED 76 is disposed at the center of the array 88. A first one of the second LED 78 is disposed at a first end of the array 88 and corresponding to a negative polarity and the second one of the second LEDs is disposed at a second end of the array corresponding to a positive polarity. An equal number of the third LEDs are disposed intermediate each one of the second LED 78 and the first LED 76. Each of the third LEDs 80 adjacent the first LED 76 indicates a first increment of the magnitude of the difference. In a preferred embodiment of the present invention, this increment may be five cents. This increment of the magnitude doubles for each successive one of the third LEDs and second LEDs encounter toward said first end and said second end of the array 88.

It is particularly useful in the tuner 10 such that the first LED 76 is adapted to display green light. The second LEDs may be adapted to display red light and the third LED is adapted to display yellow light. Also, since the first LED 76 is coupled through resistors 82 and 84, when pins P3.0 and P3.1 go low, the current through first LED 76 is twice that for the current through any of the second LED 78 and third LED 80. It should be noted that the difference signal only illuminates one of the above-described LEDs, 76, 78 and 80. When the difference is minimized, the difference signal causes the first LED 76 to emit twice the optical energy of the second LED 78 and third LED 80.

The displaying means 24 also includes a plurality of normally open switches 90. Each of the switches 90 are coupled in series between a corresponding one of third LED 80 and ground potential, as best seen in FIG. 4. Switches 90 are of the type which momentarily close when pressed, such as the membrane type switch as best seen in FIG. 8. Each of the switches 90 represents a corresponding one of the strings 14, which may be indicated by appropriate indicia on an exterior surface 92 of the display means 24. Momentarily closing of one of the switches 90 develops a voltage transition across the closed switch. The voltage transmission is sensed that the corresponding one of pins P1.1–P1.6. The microprocessor in response to the voltage transition determines a proper value of the in tune frequency to be used. The proper value of the frequency is associated with the selected one of the strings. Also, the momentary closing of the switch causes a current through the third LED 80 attached thereto to provide visual confirmation. The microprocessor 26, the control of system software as described hereinbelow, repeatedly scans switches 90 to determine when a voltage transition does exits to indicate that one of the strings will be tuned and select a proper frequency.

In a further embodiment of the present invention, displaying means 24 also includes a plurality of further LEDs 94 and a plurality of normally open switches 96. Each of the switches 96 are coupled in series between a cathode of a corresponding one of the LEDs 94 and ground potential. The anode of each of the LED 94 is commonly connected to resistor 86. The face 92 of displaying means 24 may contain certain indicia such that each of the switches 96 represents a selected tonal increment from an audible tone heard at the in tune frequency. Closing of one of the switches 96 will make the corresponding one of the LED 94 and develops a voltage transition across the switch 96. The microprocessor 26 in response to this voltage transition occurring at one of pins P3.3–P3.5 changes the in tune frequency in accordance with the selected tonal increment. Also the closing of the switch 96 develops a current through to the corresponding LED 94 for a visual confirmation. The tonal increment in a preferred embodiment of the present invention may represent half tone steps. A half tone step may be either sharp or flat in tonal polarity. Again, the microprocessor 26 scans these switches to determine if one has been closed momentarily.

With reference to each of FIG. 1 and FIG. 5, the electronic tuner 10 of the present invention further comprises means 98 for muting the instrument 12 during tuning of the selected one of the strings 14. Muting means 98 may include a normally conductive transistor switch 100 having a source, S, a drain, D, and a gate, G. The audio analog signal is applied to the source, S, and is coupled through the switch 100 to the drain, D. Muting means further includes means 102 for selectively biasing the gate, G, to turn the transistor switch 100 off when muting is desired. In a preferred embodiment of the present invention, transistor switch 100 may be a P-channel JFET 104.

The biasing means 120 include a flip-flop 106 and a normally open switch 108. Flip-flop 106 has a set input, S, a reset input, R, a logical output, Q. The logical output, Q (not) is electrically coupled to the gate of the FET 104. In normal operation, the logical output Q of the flip-flop 106 develops a bias voltage to maintain the transistor switch 100 on. As best seen in FIG. 5, the signals applied to the set input, S, and reset input, R, are logically inverted.

The normally open first switch 108 is coupled to the reset input, R, and ground potential. Closing of the switch 108 develops a voltage transition at the reset input, R, to change a logical state of the bias voltage to turn the transistor switch 100 off thereby muting the instrument 12. Voltage transition is caused by current through a resistor 110 coupled between the bias voltage, $V_{bb}$, and the reset input, R. In a preferred embodiment of the present invention, resistor 110 may be a 4.7k resistor.

Biasing means 98 further includes a normally open switch 112 coupled intermediate the set input S of the flip-flop 106 and ground potential. The set input S of the flip-flop 106 is also coupled to the bias potential $V_{bb}$ through a resistor 114. In a preferred embodiment of the present invention, resistor 114 may also be a 4.7k ohm resistor. A voltage transition at the set input changes the logical state of the bias voltage to turn the transistor switch 100 on thereby allowing induction between the audio and an audio out as best seen in FIG. 5.

When muting the instrument 12, an audio sound is developed through a high powered amplifier, the switching of the transistor switch 100 may cause thump in the speakers. Accordingly, a capacitor 116 is electrically coupled between the gate of the transistor switch 100 and ground potential filter switching transients which may cause an audible thump to be heard. The flip-flop 106 may also be a 74C74 flip-flop which is commercially available.

The biasing means 98 further includes a pair of filter circuits 118. Each of the filter circuits 118 includes a resistor 120 coupled between a corresponding one of the source, S, and drain, D, and ground potential to reduce residual DC voltage in the audio signal. The filter circuits 118 also include a pair of diodes 122, 124 electrically coupled between the corresponding one of the source and the drain of the transistor switch 100. The first diode 122 is coupled in reverse polarity to the second diode 124. The diodes prevent DC splice at the corresponding one of the source S and drain D of the transistor switch 100. Since the normal forward conduction voltage drop in each first diode 122 and second diode 124 is 0.6 volts, the audio signal which is in millivolts does not cause forward biasing of either diodes 122 or 124. Biasing means 98 also includes a capacitor 126 coupled between the set input S and ground potential. In power up of the tuner 10, as the voltage, $V_{bb}$, increases, the voltage at the set input, S, is maintained low to force a set of the flip-flop 106 so that transistor switch 100 is conductive on power up.

With reference now to FIG. 1 and FIG. 6, the electronic tuner 10 also includes a power supply 128 to develop each of the bias potentials, $V_{bb}$ and $V_{cc}$. The power supply 128 includes a PNP power supply transistor 130, a normally open first switch 132, an NPN control transistor 134, a first zener diode 136 and a normally open second switch 138.

The power supply transistor 130 has an emitter adapted for electrical coupling to a positive terminal of a battery 140, a collector and a base. In the preferred embodiment of the present invention, battery 140 may be a 9 volt battery which is removable as indicated in FIG. 6. The first switch 132 is resistively coupled to the base of transistor 130 through resistor 142 and diode 144. Momentary closing of switch 132 turns transistor 130 on into saturation whereby voltage of battery 140 is developed at the collector of switch 130, this voltage being $V_{bb}$. The control transistor 134 has an emitter adapted to be coupled to ground potential, collector electrically coupled to the first switch 132 and a base adapted for coupling to a negative terminal of the battery 140.

The zener diode 136 has an anode resistively coupled through a resistor 146 to the base of the control transistor 134 and a cathode coupled to the collector of the power supply transistor 130. The control transistor saturates in response to the power supply transistor being turned on thereby maintaining the base of the power supply transistor 130 at a low voltage to keep the power supply transistor on. The second switch 138 is coupled between the base of the control transistor 134 and ground potential. Momentary closing of the second switch turns the control transistor off to remove the base bias voltage from the base of the power supply transistor 130. The transistor 130 is then turned off. The emitter of the control transistor 134 is coupled to ground potential through the inverse logic output, Q of a flip-flop 148. The logical inverse set input of the flip-flop 148 is coupled to the capacitor 126 of muting means 98 such that flip-flop 148 is set on power up. The inverse logic output Q is therefore at zero volts or ground potential. When the tuning apparatus is turned on and not used for a given length of time, a strobe pulse is developed at pin P3.6 which is applied to the clock input C of the flip-flop 148. The strobe pulse changes the output state causing the voltage at the inverse logic output Q to go high thereby turning off the control transistor 134. As described hereinabove when transistor 134 turns off, the base bias is removed from transistor 130, turning off the power supply. In a preferred embodiment of the present invention, flip-flop 148 may also be 74C74 commercially available flip-flop.

Power supply 128 further includes a voltage regulator 150 for developing a well regulated logic level second bias voltage, $V_{cc}$ in response to the first bias voltage, $V_{bb}$. As battery 140 discharges, the bias voltage $V_{bb}$ may be insufficient. Therefore, the power supply also includes a low power indicator circuit 152.

Indicator circuit 152 has a second NPN transistor 154 and a second zener diode 156. The transistor 154 has a collector resistively coupled to the bias voltage $V_{cc}$ through a resistor 158, an emitter coupled to ground potential and a base resistively coupled to the anode of zener diode 156 through a resistor 160. Zener diode 156 has its cathode coupled to the first bias potential $V_{bb}$. The NPN transistor 154 is saturated when the battery 140 has sufficient voltage. The second NPN transistor 154 turns off when the battery voltage falls below a reverse breakdown voltage of the second zener diode 156. The collector of the second NPN transistor 154 develops a collector voltage substantially equal to the second bias voltage $V_{cc}$ when the second transistor turns off. This collector voltage is coupled to the microprocessor 26 at pin P3.7. When this collector voltage is sensed, the microprocessor may develop a further signal, the displaying means in response may visually indicate the low voltage of the battery. This may be done through the first LED 78.

A complete listing of the 8051 assembler language program stored in ROM 28 of the CPU 22 is attached hereto as Appendix A. FIGS. 10–15 are self-explanatory flowcharts summarizing the operation of the program in Appendix A.

There has been described hereinabove a novel electronic tuner constructed according to the principles of the present invention. Those skilled in the art may now make numerous uses of and modifications to the exemplary preferred embodiment without departing from the inventive concepts disclosed herein. Accordingly, the present invention is to be defined solely by the scope of the following claims.

```
                $TITLE  MUSIC TUNER

007E =          KEY_MASK        EQU     07EH    ; 6 STRING KEY MASK
                ; KEY_MASK      EQU     07CH    ; 5 STRING KEY MASK
                ; KEY_MASK      EQU     078H    ; 4 STRING KEY MASK

0000 =          GROUP_MASK      EQU     00H     ; 6 STRING GROUP MASK
                ; GROUP_MASK    EQU     020H    ; 5 STRING GROUP MASK
                ; GROUP_MASK    EQU     040H    ; 4 STRING GROUP MASK

0000                    DSEG
0018                    ORG     24
0018            SLEEP_COUNT:    DS      1
0019            LIGHT_COUNT:    DS      1
001A            TONE_COUNT:     DS      1
001B            KB_SCAN_COUNT:  DS      1
001C            K100MS:         DS      1
001D            K1SEC:          DS      1
001E            P1_IMAGE:       DS      1
001F            P2_IMAGE:       DS      1
0020            P3_IMAGE:       DS      1       ; START OF BIT SPACE
0021            CUR_TBL:        DS      1
0022            SAMPLE_COUNT:   DS      1
0023            MATCH_COUNT:    DS      1
0024            HELPER:         DS      1
0025            TABLE_ADDR:     DS      2
0027            SAMPLE:         DS      2
0029            TEST_CODE:      DS      1
002A            OLD_CODE:       DS      1
002B            CUR_COUNT:      DS      1
002C            SAMPLE_STATUS:  DS      1
002D            SAMPLE_INDEX:   DS      1
002E            SAMPLE_TIME:    DS      2
0030            SAMPLE_FREQ:    DS      2
0032            TEST_PULSE:     DS      2
0034            TEST_COUNT:     DS      1
0035            TEST_TIME:      DS      2
0037            TEST_FREQ:      DS      2
0039            MISSED_COUNT:   DS      1
003A            FREQ_COUNT:     DS      1
003B            TEST_MODE:      DS      1
003C            FREQ_DELTA:     DS      2
003E            PULSE_DELTA:    DS      2
0040            BASE_FREQ:      DS      2
0042            TOP_FREQ:       DS      2
0044            AV_FREQ:        DS      3
0047            MAX_FREQ:       DS      2
0049            MIN_FREQ:       DS      2
004B            MAX_PULSE:      DS      2
004D            MIN_PULSE:      DS      2
004F            FINAL_FREQ:     DS      2
0051            LOW_DELTA:      DS      2
0053            HIGH_DELTA:     DS      2
0055            SAMPLE_OUT:     DS      1
0056            SAMPLE_ARRAY:   DS      10
0060            SAMPLE_ARRAY_END:       DS      1
0061            TEST_ARRAY:     DS      10

006B            STACK_BASE:     DS      1

0001 =          TONE_TIME       EQU     1
0002 =          KEY_TIME        EQU     2
0019 =          SLEEP_TIME      EQU     25

                ;       PORT PIN ASSIGNMENTS
                ;
```

```
;       P1 OUTPUT ASSIGNMENTS
;
;       P1.0    +40c
;       P1.1    +20c
;       P1.2    +10c
;       P1.3    +5c
;       P1.4    -5c
;       P1.5    -10c
;       P1.6    -20c
;       P1.7    -40c
;
;       P1 INPUT ASSIGNMENTS    (LOW TRUE)
;
;       P1.0    NONE
;       P1.1    SW6     (E4)
;       P1.2    SW5     (B3)
;       P1.3    SW4     (G3)
;       P1.4    SW3     (D3)
;       P1.5    SW2     (A2)
;       P1.6    SW1     (E2)
;       P1.7    NONE
;
;       P3 OUTPUT ASSIGNMENTS
;
;       P3.0    CENTER LED
;       P3.1    CENTER LED
;       P3.2    NONE
;       P3.3    -2 SEMI TONE LAMP
;       P3.4    -1 SEMI TONE LAMP
;       P3.5    FULL TONE LAMP
;       P3.6    NONE
;       P3.7    NONE
;
;       P3 INPUT ASSIGNMENTS
;
;       P3.0    NONE
;       P3.1    NONE
;       P3.2    DIGITAL AUDIO
;       P3.3    -2 SEMI TONE SWITCH
;       P3.4    -1 SEMI TONE SWITCH
;       P3.5    FULL TONE SWITCH
;       P3.6    NONE
;       P3.7    POWER LOW INDICATER (LOW = POWER OK)
;
;       CUR_TBL         TABLE INDEX
;       BITS 0.1.2      STRING TABLE NUMBER
;       BITS 3.4        SEMI TONE INDEX
;       BITS 5.6        TABLE GROUP NUMBER
;
;       TABLE INDEX
;       0       NOT USED
;       1       SW1
;       2       SW2
;       3       SW3
;       4       SW4
;       5       SW5
;       6       SW6
;       7       NOT USED
;
;       SEMI TONE INDEX
;       0       FULL
;       1       -1 SEMI TONE
;       2       -2 SEMI TONE
;
;       TABLE GROUPS
;       0       6 STRING
;       1       5 STRING
;       2       4 STRING
;
;
0000            CSEG
;               ORG     0
0000 020100     LJMP    START
;               ORG     3H
0003 020779     LJMP    INTERUPT_0
0006            DS      5,0
;               ORG     0BH
```

```
000B 0207B0          LJMP    TIMER0_INTERUPT
000E                 DS      5.0
                 :   ORG     013H
0013 020712          LJMP    INTERUPT_1
0016                 DS      5.0
                 :   ORG     01BH
001B 020713          LJMP    TIMER1_INTERUPT
001E                 DS      5.0
                 :   ORG     023H
0023 0207B1          LJMP    SERIAL_INTERUPT
0026                 DS      0DAH.0
                 :   ORG     100H
                 :%S     START LOCATION FOR SIMULATOR
                 ;
                 START:
0100 7400            MOV     A.#0
0102 7800            MOV     R0.#0
0104 7590FF          MOV     P1.#0FFH
0107 75B0DF          MOV     P3.#0DFH
                 CLR_RAM:
010A F6              MOV     @R0.A
010B 08              INC     R0
010C B680FB          CJNE    R0.#128.CLR_RAM
010F 75816B          MOV     SP.#STACK_BASE

0112 751EFF          MOV     P1_IMAGE.#0FFH
0115 7590FF          MOV     P1.#0FFH
0118 75B0DF          MOV     P3_IMAGE.#0DFH
011B 75B0DF          MOV     P3.#0DFH
011E 759800          MOV     SCON.#0          : NO SERIAL PORT
0121 75A800          MOV     IE.#0            : DISABLE ALL INTERUPTS
0124 758919          MOV     TMOD.#019H
0127 758851          MOV     TCON.#051H       : ENABLE TIMERS & SET EDGE LEV
012A 751D10          MOV     K1SEC.#16
012D 752D56          MOV     SAMPLE_INDEX.#SAMPLE_ARRAY
0130 755556          MOV     SAMPLE_OUT.#SAMPLE_ARRAY
0133 758D00          MOV     TH1.#0H
0136 758B00          MOV     TL1.#0
0139 75A888          MOV     IE.#088H                 : TIMER 1
013C 75B801          MOV     IP.#1            : EXTERNAL 0 TOP PRIORITY
013F 751819          MOV     SLEEP_COUNT.#SLEEP_TIME
0142 751B01          MOV     KB_SCAN_COUNT.#1


                 KB_SCAN_LOOP:
0145 E52D            MOV     A.SAMPLE_INDEX
0147 C3              CLR     C
0148 9555            SUBB    A.SAMPLE_OUT
014A 6003            JZ      NOT_READY
014C 0202B4          LJMP    SAMPLE_READY_TEST


                 NOT_READY:
014F E52C            MOV     A.SAMPLE_STATUS
0151 6006            JZ      XNR1
0153 12049F          LCALL   SET_FINAL_FREQ
0156 02061F          LJMP    DISPLAY_FREQ
                 XNR1:
0159 E51B            MOV     A.KB_SCAN_COUNT
015B 70E8            JNZ     KB_SCAN_LOOP
015D 751B01          MOV     KB_SCAN_COUNT.#1
0160 7590FF          MOV     P1.#0FFH
0163 E590            MOV     A.P1
0165 851E90          MOV     P1.P1_IMAGE
0168 F4              CPL     A
0169 547E            ANL     A.#KEY_MASK              : AND OUT UNWANTED
016B 601B            JZ      TEST_PORT_3
016D F4              CPL     A
016E F51E            MOV     P1_IMAGE.A
0170 F590            MOV     P1.A
0172 F4              CPL     A
0173 C3              CLR     C
0174 7A00            MOV     R2.#0
                 KB1:
0176 0A              INC     R2
0177 33              RLC     A
0178 50FC            JNC     KB1
017A 1A              DEC     R2       : BASE 0
```

```
017B E521          MOV     A.CUR_TBL
017D 5418          ANL     A.#018H
017F 4A            ORL     A.R2
0180 4400          ORL     A.#GROUP_MASK
0182 B52167        CJNE    A.CUR_TBL.NEW_TABLE
0185 020276        LJMP    LIGHTS_ON

                TEST_PORT_3:
0188 20B75E        JB      0B7H.XLOW_POWER ; TEST POWER
018B D2B3          SETB    0B3H
018D 20B311        JB      0B3H.NOT_2
0190 7A10          MOV     R2.#010H
0192 D2B4          SETB    0B4H
0194 D2B5          SETB    0B5H
0196 D204          SETB    04H
0198 D205          SETB    05H
019A C203          CLR     03H
019C C2B3          CLR     0B3H
019E 0201D4        LJMP    P3_SET

                NOT_2:
01A1 200302        JB      03H.NOT_2A
01A4 C2B3          CLR     0B3H
                NOT_2A:
01A6 D2B4          SETB    0B4H
01A8 20B411        JB      0B4H.NOT_1
01AB 7A08          MOV     R2.#08H
01AD C2B4          CLR     0B4H
01AF C204          CLR     04H
01B1 D203          SETB    03H
01B3 D205          SETB    05H
01B5 D2B3          SETB    0B3H
01B7 D2B5          SETB    0B5H
01B9 0201D4        LJMP    P3_SET
                NOT_1:
01BC 200402        JB      04H.NOT_1A
01BF C2B4          CLR     0B4H
                NOT_1A:
01C1 D2B5          SETB    0B5H
01C3 20B51B        JB      0B5H.NOT_0
01C6 7A00          MOV     R2.#0
01C8 C2B5          CLR     0B5H
01CA C205          CLR     05H
01CC D204          SETB    04H
01CE D203          SETB    03H
01D0 D2B4          SETB    0B4H
01D2 D2B3          SETB    0B3H
                P3_SET:
01D4 E521          MOV     A.CUR_TBL
01D6 5407          ANL     A.#007H
01D8 4A            ORL     A.R2
01D9 4400          ORL     A.#GROUP_MASK
01DB B5210E        CJNE    A.CUR_TBL.NEW_TABLE
01DE 020276        LJMP    LIGHTS_ON

                NOT_0:
01E1 200502        JB      05H.NOT_0A
01E4 C2B5          CLR     0B5H
                NOT_0A:
01E6 020145        LJMP    KB_SCAN_LOOP


                XLOW_POWER:
01E9 020295        LJMP    LOW_POWER

                NEW_TABLE:
01EC F521          MOV     CUR_TBL.A
01EE 9007B2        MOV     DPTR.#TABLES
01F1 23            RL      A
01F2 FA            MOV     R2.A
01F3 93            MOVC    A.@A+DPTR
01F4 FB            MOV     R3.A
01F5 EA            MOV     A.R2
01F6 04            INC     A
01F7 93            MOVC    A.@A+DPTR
01F8 FC            MOV     R4.A            ; TABLE ADDR
01F9 8B83          MOV     DPH.R3
01FB 8C82          MOV     DPL.R4
01FD 7400          MOV     A.#0
01FF 93            MOVC    A.@A+DPTR       ; NUMBER OF SAMPLES
0200 F522          MOV     SAMPLE_COUNT.A
```

```
0202 7401        MOV     A,#1
0204 93          MOVC    A,@A+DPTR          ; MIN MATCHING TESTS
0205 F523        MOV     MATCH_COUNT,A
0207 7402        MOV     A,#2
0209 93          MOVC    A,@A+DPTR
020A F524        MOV     HELPER,A           ; A/D HELPER
                 ;       MOV     R0,#0
                 ;       MOVX    @R0,A      ; FIRE IT
020C 7403        MOV     A,#3
020E 93          MOVC    A,@A+DPTR
020F F525        MOV     TABLE_ADDR,A       ; LIMIT TABLE ADDR
0211 7404        MOV     A,#4
0213 93          MOVC    A,@A+DPTR
0214 F526        MOV     TABLE_ADDR+1,A

0216 F582        MOV     DPL,A
0218 E525        MOV     A,TABLE_ADDR
021A F583        MOV     DPH,A
021C 7400        MOV     A,#0
021E 93          MOVC    A,@A+DPTR
021F FA          MOV     R2,A
0220 7401        MOV     A,#1
0222 93          MOVC    A,@A+DPTR
0223 FB          MOV     R3,A
0224 740E        MOV     A,#14
0226 93          MOVC    A,@A+DPTR
0227 FC          MOV     R4,A
0228 740F        MOV     A,#15
022A 93          MOVC    A,@A+DPTR
022B FD          MOV     R5,A
022C C3          CLR     C
022D 9B          SUBB    A,R3
022E F53D        MOV     FREQ_DELTA+1,A
0230 EC          MOV     A,R4
0231 9A          SUBB    A,R2
0232 F53C        MOV     FREQ_DELTA,A
0234 EB          MOV     A,R3
0235 C3          CLR     C
0236 953D        SUBB    A,FREQ_DELTA+1
0238 F541        MOV     BASE_FREQ+1,A
023A EA          MOV     A,R2
023B 953C        SUBB    A,FREQ_DELTA
023D F540        MOV     BASE_FREQ,A
023F ED          MOV     A,R5
0240 C3          CLR     C
0241 253D        ADD     A,FREQ_DELTA+1
0243 F543        MOV     TOP_FREQ+1,A
0245 EC          MOV     A,R4
0246 353C        ADDC    A,FREQ_DELTA
0248 F542        MOV     TOP_FREQ,A

024A E541        MOV     A,BASE_FREQ+1
024C C3          CLR     C
024D 33          RLC     A
024E F541        MOV     BASE_FREQ+1,A
0250 E540        MOV     A,BASE_FREQ
0252 33          RLC     A
0253 F540        MOV     BASE_FREQ,A
                 ;                          *4 TABLE
0255 E541        MOV     A,BASE_FREQ+1
0257 C3          CLR     C
0258 33          RLC     A
0259 F541        MOV     BASE_FREQ+1,A
025B E540        MOV     A,BASE_FREQ
025D 33          RLC     A
025E F540        MOV     BASE_FREQ,A

0260 E543        MOV     A,TOP_FREQ+1
0262 C3          CLR     C
0263 33          RLC     A
0264 F543        MOV     TOP_FREQ+1,A
0266 E542        MOV     A,TOP_FREQ
0268 33          RLC     A
0269 F542        MOV     TOP_FREQ,A
                 ;                          *4 TABLE
026B E543        MOV     A,TOP_FREQ+1
026D C3          CLR     C
026E 33          RLC     A
026F F543        MOV     TOP_FREQ+1,A
0271 E542        MOV     A,TOP_FREQ
0273 33          RLC     A
0274 F542        MOV     TOP_FREQ,A
```

```
                LIGHTS ON:
0276 E520               MOV     A,P3_IMAGE
0278 4403               ORL     A,#03H
027A F520               MOV     P3_IMAGE,A
027C D2B0               SETB    0B0H
027E D2B1               SETB    0B1H            ; TURN OFF CENTER LAMP
0280 752B00             MOV     CUR_COUNT,#0
0283 753B00             MOV     TEST_MODE,#0
0286 751D10             MOV     K1SEC,#16
0289 751902             MOV     LIGHT_COUNT,#KEY_TIME
028C 751819             MOV     SLEEP_COUNT,#SLEEP_TIME
028F 75A889             MOV     IE,#089H        ; ENABEL EXTERNAL INTERUPT 0
0292 020145             LJMP    KB_SCAN_LOOP

                LOW_POWER:
0295 75A888             MOV     IE,#088H        ; DISABLE EXTERNAL INTERUPTS
0298 7590FF             MOV     P1,#0FFH
029B 75B0FC             MOV     P3,#0FCH

                LOW_POWER_LOOP:
029E 751A01             MOV     TONE_COUNT,#1
                LPL1:
02A1 E51A               MOV     A,TONE_COUNT
02A3 70FC               JNZ     LPL1
02A5 751A01             MOV     TONE_COUNT,#1
02A8 75B0FF             MOV     P3,#0FFH
                LPL2:
02AB E51A               MOV     A,TONE_COUNT
02AD 70FC               JNZ     LPL2
02AF 75B0FC             MOV     P3,#0FCH
02B2 80EA               SJMP    LOW_POWER_LOOP


                SAMPLE_READY_TEST:
                ;       TEST THE SAMPLE
02B4 A855               MOV     R0,SAMPLE_OUT
02B6 862E               MOV     SAMPLE_TIME,@R0
02B8 08                 INC     R0
02B9 862F               MOV     SAMPLE_TIME+1,@R0
02BB 08                 INC     R0
02BC B86002             CJNE    R0,#SAMPLE_ARRAY_END,SRT1
02BF 7856               MOV     R0,#SAMPLE_ARRAY

                SRT1:
02C1 8855               MOV     SAMPLE_OUT,R0
02C3 E53B               MOV     A,TEST_MODE
02C5 6011               JZ      TEST_RESTART
02C7 14                 DEC     A
02C8 6026               JZ      HUNT
02CA 14                 DEC     A
02CB 6055               JZ      FIND_FIRST_PULSE
02CD 14                 DEC     A
02CE 6072               JZ      FIND_FIRST_FREQ
02D0 14                 DEC     A
02D1 6002               JZ      XFIND_NEXT_FREQ
02D3 8003               SJMP    TEST_RESTART
                XFIND_NEXT_FREQ:
02D5 020367             LJMP    FIND_NEXT_FREQ

                TEST_RESTART:
02D8 753200             MOV     TEST_PULSE,#0
02DB 753300             MOV     TEST_PULSE+1,#0
02DE 753400             MOV     TEST_COUNT,#0
02E1 753700             MOV     TEST_FREQ,#0
02E4 753800             MOV     TEST_FREQ+1,#0
02E7 753B01             MOV     TEST_MODE,#1
02EA 753A00             MOV     FREQ_COUNT,#0
02ED 752AFF             MOV     OLD_CODE,#-1
                ;       SETB    0B3H
                ;       SETB    3H

                HUNT:
02F0 852E35             MOV     TEST_TIME,SAMPLE_TIME
02F3 852F36             MOV     TEST_TIME+1,SAMPLE_TIME+1
02F6 753B03             MOV     TEST_MODE,#3
02F9 020145             LJMP    KB_SCAN_LOOP


02FC E527               MOV     A,SAMPLE
02FE C3                 CLR     C
02FF 9532               SUBB    A,TEST_PULSE
0301 6004               JZ      HUNT_1
```

```
0303 400E          JC      HUNT_10
0305 8009          SJMP    HUNT_5
                HUNT_1:
0307 E528          MOV     A,SAMPLE+1
0309 C3            CLR     C
030A 9533          SUBB    A,TEST_PULSE+1
030C 6002          JZ      HUNT_5
030E 4003          JC      HUNT_10
                HUNT_5:
0310 1203B6        LCALL   SET_PULSE
                HUNT_10:
0313 0534          INC     TEST_COUNT
0315 E534          MOV     A,TEST_COUNT
0317 B40A05        CJNE    A,#10,HUNT_OUT
031A 053B          INC     TEST_MODE
031C 753400        MOV     TEST_COUNT,#0
                HUNT_OUT:
031F 020145        LJMP    KB_SCAN_LOOP

                FIND_FIRST_PULSE:
0322 12055E        LCALL   VALIDATE_PULSE
0325 700E          JNZ     FFP_OUT
0327 1203B6        LCALL   SET_PULSE
032A 1203E8        LCALL   SET_TIME
032D 053B          INC     TEST_MODE
032F 753400        MOV     TEST_COUNT,#0
0332 020145        LJMP    KB_SCAN_LOOP
                FFP_OUT:
0335 0534          INC     TEST_COUNT
0337 E534          MOV     A,TEST_COUNT
0339 B41403        CJNE    A,#20,FFP_OUT1
033C 0202D8        LJMP    TEST_RESTART
                FFP_OUT1:
033F 020145        LJMP    KB_SCAN_LOOP


                FIND_FIRST_FREQ:
0342 12055E        LCALL   VALIDATE_PULSE
0345 4013          JC      FFF_OUT
0347 7011          JNZ     FFF_OUT
0349 1203EF        LCALL   SET_FIRST_FREQ
034C 1203E8        LCALL   SET_TIME
034F 753400        MOV     TEST_COUNT,#0
0352 053B          INC     TEST_MODE
0354 753A00        MOV     FREQ_COUNT,#0
0357 020145        LJMP    KB_SCAN_LOOP
                FFF_OUT:
035A 0534          INC     TEST_COUNT
035C E534          MOV     A,TEST_COUNT
035E B40A03        CJNE    A,#10,FF_OUT1
0361 0202D8        LJMP    TEST_RESTART
                FF_OUT1:
0364 020145        LJMP    KB_SCAN_LOOP

                FIND_NEXT_FREQ:
0367 12055E        LCALL   VALIDATE_PULSE
036A 4004          JC      FNF7
036C 7015          JNZ     FNF8
036E 8023          SJMP    FNF10
                FNF7:
0370 0534          INC     TEST_COUNT
0372 E534          MOV     A,TEST_COUNT
0374 B41403        CJNE    A,#20,FNF_OUT
0377 0202D8        LJMP    TEST_RESTART
                FNF_OUT:
037A 020145        LJMP    KB_SCAN_LOOP

                FNF5:
037D 753B00        MOV     TEST_MODE,#0
0380 020145        LJMP    KB_SCAN_LOOP
                FNF8:
0383 1203E8        LCALL   SET_TIME
0386 753400        MOV     TEST_COUNT,#0
0389 053A          INC     FREQ_COUNT
038B E53A          MOV     A,FREQ_COUNT
038D B403EA        CJNE    A,#3,FNF_OUT
0390 0202D8        LJMP    TEST_RESTART

                FNF10:
0393 1205D1        LCALL   VALIDATE_FREQ
```

```
0396 6004          JZ      FNF15
0398 40D6          JC      FNF7
039A 70D4          JNZ     FNF7
                FNF15:
                ;       CLR     03H
                ;       CLR     0B3H
039C 120425        LCALL   SET_FREQ
039F 1203E8        LCALL   SET_TIME
03A2 753400        MOV     TEST_COUNT,#0
03A5 753A00        MOV     FREQ_COUNT,#0
03A8 752C01        MOV     SAMPLE_STATUS,#1
03AB E52D          MOV     A,SAMPLE_INDEX
03AD B555CA        CJNE    A,SAMPLE_OUT,FNF_OUT
03B0 12049F        LCALL   SET_FINAL_FREQ
03B3 02061F        LJMP    DISPLAY_FREQ

                SET_PULSE:
03B6 E527          MOV     A,SAMPLE
03B8 F532          MOV     TEST_PULSE,A
03BA E528          MOV     A,SAMPLE+1
03BC F533          MOV     TEST_PULSE+1,A
03BE A927          MOV     R1,SAMPLE
03C0 AA28          MOV     R2,SAMPLE+1
03C2 7B04          MOV     R3,#4
                SP_6:
03C4 C3            CLR     C
03C5 C9            XCH     A,R1
03C6 13            RRC     A
03C7 C9            XCH     A,R1
03C8 CA            XCH     A,R2
03C9 13            RRC     A
03CA CA            XCH     A,R2
03CB DBF7          DJNZ    R3,SP_6
03CD 893E          MOV     PULSE_DELTA,R1
03CF 8A3F          MOV     PULSE_DELTA+1,R2
03D1 E533          MOV     A,TEST_PULSE+1
03D3 C3            CLR     C
03D4 3A            ADDC    A,R2
03D5 F54C          MOV     MAX_PULSE+1,A
03D7 E532          MOV     A,TEST_PULSE
03D9 39            ADDC    A,R1
03DA F54B          MOV     MAX_PULSE,A
03DC E533          MOV     A,TEST_PULSE+1
03DE C3            CLR     C
03DF 9A            SUBB    A,R2
03E0 F54E          MOV     MIN_PULSE+1,A
03E2 E532          MOV     A,TEST_PULSE
03E4 99            SUBB    A,R1
03E5 F54D          MOV     MIN_PULSE,A
03E7 22            RET

                SET_TIME:
03E8 852E35        MOV     TEST_TIME,SAMPLE_TIME
03EB 852F36        MOV     TEST_TIME+1,SAMPLE_TIME+1
03EE 22            RET

                SET_FIRST_FREQ:
03EF 020425        LJMP    SET_FREQ

03F2 E52F          MOV     A,SAMPLE_TIME+1
03F4 C3            CLR     C
03F5 9536          SUBB    A,TEST_TIME+1
03F7 F538          MOV     TEST_FREQ+1,A
03F9 E52E          MOV     A,SAMPLE_TIME
03FB 9535          SUBB    A,TEST_TIME
03FD F537          MOV     TEST_FREQ,A
03FF 754400        MOV     AV_FREQ,#0
0402 853745        MOV     AV_FREQ+1,TEST_FREQ
0405 853846        MOV     AV_FREQ+2,TEST_FREQ+1
0408 020425        LJMP    SET_FREQ

040B A937          MOV     R1,TEST_FREQ
040D AA38          MOV     R2,TEST_FREQ+1
040F C3            CLR     C
0410 CA            XCH     A,R2
0411 33            RLC     A
0412 CA            XCH     A,R2
0413 C9            XCH     A,R1
0414 33            RLC     A
```

```
0632 EB                 MOV     A,R3
0633 93                 MOVC    A,@A+DPTR
0634 33                 RLC     A
0635 C3                 CLR     C
0636 954F               SUBB    A,FINAL_FREQ
0638 6005               JZ      TEST_LOW_BYTE
063A 500F               JNC     MATCH_FOUND
063C 020665             LJMP    TEST_NEXT
                TEST_LOW_BYTE:
063F EB                 MOV     A,R3
0640 04                 INC     A
0641 93                 MOVC    A,@A+DPTR
0642 C3                 CLR     C
0643 33                 RLC     A
0644 C3                 CLR     C
0645 9550               SUBB    A,FINAL_FREQ+1
0647 601C               JZ      TEST_NEXT
0649 401A               JC      TEST_NEXT
                MATCH_FOUND:
064B 7461               MOV     A,#TEST_ARRAY
064D 252B               ADD     A,CUR_COUNT
064F F8                 MOV     R0,A
0650 A604               MOV     @R0,R4
0652 052B               INC     CUR_COUNT
0654 E52B               MOV     A,CUR_COUNT
0656 B40A06             CJNE    A,#10,COUNT_OK
0659 752B00             MOV     CUR_COUNT,#0
065C 020677             LJMP    SAMPLE_TEST_OUT
                COUNT_OK:
065F B52215             CJNE    A,SAMPLE_COUNT,SAMPLE_TEST_OUT
0662 02067A             LJMP    DISPLAY_RESULTS

                TEST_NEXT:
0665 0B                 INC     R3
0666 0B                 INC     R3
0667 EC                 MOV     A,R4
0668 23                 RL      A
0669 7002               JNZ     NOT_PLUS40
066B 7401               MOV     A,#1
                NOT_PLUS40:
066D FC                 MOV     R4,A
066E 1A                 DEC     R2
066F EA                 MOV     A,R2
0670 70BB               JNZ     LAMP_TEST_LOOP
0672 7C80               MOV     R4,#080H        ; - 40
0674 02064B             LJMP    MATCH_FOUND

                SAMPLE_TEST_OUT:
0677 020145             LJMP    KB_SCAN_LOOP

                DISPLAY_RESULTS:
067A 752900             MOV     TEST_CODE,#0
067D 7B09               MOV     R3,#9
                OUTER_LOOP:
067F 7C00               MOV     R4,#0
0681 AD22               MOV     R5,SAMPLE_COUNT
0683 7861               MOV     R0,#TEST_ARRAY
                INNER_LOOP:
0685 E6                 MOV     A,@R0
0686 B52901             CJNE    A,TEST_CODE,NOT_EQUAL
0689 0C                 INC     R4
                NOT_EQUAL:
068A 08                 INC     R0
068B 1D                 DEC     R5
068C BD00F6             CJNE    R5,#0,INNER_LOOP
068F EC                 MOV     A,R4
0690 C3                 CLR     C
0691 9523               SUBB    A,MATCH_COUNT
0693 6015               JZ      FOUND_IT
0695 5013               JNC     FOUND_IT
0697 E529               MOV     A,TEST_CODE
0699 23                 RL      A
069A 7002               JNZ     CODE_NOT_ZERO
069C 7401               MOV     A,#1
                CODE_NOT_ZERO:
069E F529               MOV     TEST_CODE,A
06A0 1B                 DEC     R3
06A1 BB00DB             CJNE    R3,#0,OUTER_LOOP
```

```
                SF_6:
047B C3                 CLR     C
047C C9                 XCH     A,R1
047D 13                 RRC     A
047E C9                 XCH     A,R1
047F CA                 XCH     A,R2
0480 13                 RRC     A
0481 CA                 XCH     A,R2
0482 DBF7               DJNZ    R3,SF_6
0484 893C               MOV     FREQ_DELTA,R1
0486 8A3D               MOV     FREQ_DELTA+1,R2
0488 E538               MOV     A,TEST_FREQ+1
048A C3                 CLR     C
048B 3A                 ADDC    A,R2
048C F548               MOV     MAX_FREQ+1,A
048E E537               MOV     A,TEST_FREQ
0490 39                 ADDC    A,R1
0491 F547               MOV     MAX_FREQ,A
0493 E538               MOV     A,TEST_FREQ+1
0495 C3                 CLR     C
0496 9A                 SUBB    A,R2
0497 F54A               MOV     MIN_FREQ+1,A
0499 E537               MOV     A,TEST_FREQ
049B 99                 SUBB    A,R1
049C F549               MOV     MIN_FREQ,A
049E 22                 RET

                SET_FINAL_FREQ:
049F 752C00             MOV     SAMPLE_STATUS,#0
04A2 E525               MOV     A,TABLE_ADDR
04A4 F583               MOV     DPH,A
04A6 E526               MOV     A,TABLE_ADDR+1
04A8 F582               MOV     DPL,A
04AA E537               MOV     A,TEST_FREQ
04AC C3                 CLR     C
04AD 13                 RRC     A
04AE F54F               MOV     FINAL_FREQ,A
04B0 E538               MOV     A,TEST_FREQ+1
04B2 13                 RRC     A
04B3 F550               MOV     FINAL_FREQ+1,A
04B5 02054F             LJMP    SFF_OUT
                SFF2:
04B8 02054F             LJMP    SFF_OUT

04BB 7400               MOV     A,#0
04BD 93                 MOVC    A,@A+DPTR       ; LOW END OF TABLE
04BE F9                 MOV     R1,A
04BF 7401               MOV     A,#1
04C1 93                 MOVC    A,@A+DPTR
04C2 FA                 MOV     R2,A
04C3 740E               MOV     A,#14
04C5 93                 MOVC    A,@A+DPTR       ; HIGH END OF TABLE
04C6 FB                 MOV     R3,A
04C7 740F               MOV     A,#15
04C9 93                 MOVC    A,@A+DPTR
04CA FC                 MOV     R4,A            ; FINUP FREQ
04CB C3                 CLR     C
04CC CA                 XCH     A,R2
04CD 33                 RLC     A
04CE CA                 XCH     A,R2
04CF C9                 XCH     A,R1
04D0 33                 RLC     A
04D1 C9                 XCH     A,R1
04D2 C3                 CLR     C
04D3 CC                 XCH     A,R4
04D4 33                 RLC     A
04D5 CC                 XCH     A,R4
04D6 CB                 XCH     A,R3
04D7 33                 RLC     A
04D8 CB                 XCH     A,R3
                SFF5:
04D9 C3                 CLR     C
04DA E9                 MOV     A,R1
04DB 954F               SUBB    A,FINAL_FREQ
04DD 6004               JZ      SFF10
04DF 406F               JC      SFF_GTR
04E1 8008               SJMP    SFF20
                SFF10:
04E3 EA                 MOV     A,R2
04E4 C3                 CLR     C
```

```
04E5 9550          SUBB    A,FINAL_FREQ+1
04E7 4067          JC      SFF_GTR
04E9 6064          JZ      SFF_OUT

                   SFF20:                  ; MOVE UP ONE LEVEL
04EB EA            MOV     A,R2
04EC C3            CLR     C
04ED 9550          SUBB    A,FINAL_FREQ+1
04EF F552          MOV     LOW_DELTA+1,A
04F1 E9            MOV     A,R1
04F2 954F          SUBB    A,FINAL_FREQ
04F4 F551          MOV     LOW_DELTA,A

04F6 E550          MOV     A,FINAL_FREQ+1
04F8 C3            CLR     C
04F9 33            RLC     A
04FA F550          MOV     FINAL_FREQ+1,A
04FC E54F          MOV     A,FINAL_FREQ
04FE 33            RLC     A
04FF F54F          MOV     FINAL_FREQ,A

0501 E9            MOV     A,R1
0502 C3            CLR     C

0503 954F          SUBB    A,FINAL_FREQ
0505 6004          JZ      SFF30
0507 50E2          JNC     SFF20
0509 4008          JC      SFF50
                   SFF30:
050B EA            MOV     A,R2
050C C3            CLR     C
050D 9550          SUBB    A,FINAL_FREQ+1
050F 603E          JZ      SFF_OUT
0511 50D8          JNC     SFF20

                   SFF50:
0513 EB            MOV     A,R3
0514 C3            CLR     C
0515 954F          SUBB    A,FINAL_FREQ
0517 6004          JZ      SFF55
0519 5034          JNC     SFF_OUT
051B 8008          SJMP    SFF58
                   SFF55:
051D EC            MOV     A,R4
051E C3            CLR     C
051F 9550          SUBB    A,FINAL_FREQ+1
0521 602C          JZ      SFF_OUT
0523 502A          JNC     SFF_OUT

                   SFF58:
0525 E550          MOV     A,FINAL_FREQ+1
0527 C3            CLR     C
0528 9C            SUBB    A,R4
0529 F554          MOV     HIGH_DELTA+1,A
052B E54F          MOV     A,FINAL_FREQ
052D 9B            SUBB    A,R3
052E F553          MOV     HIGH_DELTA,A

0530 C3            CLR     C
0531 E553          MOV     A,HIGH_DELTA
0533 9551          SUBB    A,LOW_DELTA
0535 6004          JZ      SFF60
0537 4016          JC      SFF_OUT
0539 8009          SJMP    SFF70
                   SFF60:
053B E554          MOV     A,HIGH_DELTA+1
053D C3            CLR     C
053E 9552          SUBB    A,LOW_DELTA+1
0540 600D          JZ      SFF_OUT
0542 400B          JC      SFF_OUT
                   SFF70:
0544 E54F          MOV     A,FINAL_FREQ
0546 C3            CLR     C
0547 13            RRC     A
0548 F54F          MOV     FINAL_FREQ,A
054A E550          MOV     A,FINAL_FREQ+1
054C 13            RRC     A
054D F54F          MOV     FINAL_FREQ,A
                   SFF_OUT:
054F 22            RET
```

```
                SFF_GTR:
0550 E54F               MOV     A,FINAL_FREQ
0552 C3                 CLR     C
0553 13                 RRC     A
0554 F54F               MOV     FINAL_FREQ,A
0556 E550               MOV     A,FINAL_FREQ+1
0558 13                 RRC     A
0559 F550               MOV     FINAL_FREQ+1,A
055B 0204D9             LJMP    SFF5


                VALIDATE_PULSE:
055E E52F               MOV     A,SAMPLE_TIME+1
0560 C3                 CLR     C
0561 9536               SUBB    A,TEST_TIME+1
0563 F531               MOV     SAMPLE_FREQ+1,A
0565 E52E               MOV     A,SAMPLE_TIME
0567 9535               SUBB    A,TEST_TIME
0569 F530               MOV     SAMPLE_FREQ,A

056B E530               MOV     A,SAMPLE_FREQ
056D C3                 CLR     C
056E 9540               SUBB    A,BASE_FREQ
0570 600E               JZ      VPF1
0572 4022               JC      VPF10   ; LESS THAN
0574 E530               MOV     A,SAMPLE_FREQ
0576 C3                 CLR     C
0577 9542               SUBB    A,TOP_FREQ
0579 6017               JZ      VPF5
057B 501D               JNC     VPF20   ; OUT OF RANGE
057D 020592             LJMP    VPF5    ; EQ
                VPF1:
0580 E531               MOV     A,SAMPLE_FREQ+1
0582 C3                 CLR     C
0583 9541               SUBB    A,BASE_FREQ+1
0585 600B               JZ      VPF5
0587 400D               JC      VPF10
0589 E531               MOV     A,SAMPLE_FREQ+1
058B C3                 CLR     C
058C 9543               SUBB    A,TOP_FREQ+1
058E 6002               JZ      VPF5
0590 5008               JNC     VPF20   ; OUT OF RANGE
                VPF5:
0592 7400               MOV     A,#0
0594 C3                 CLR     C
0595 22                 RET
                VPF10:
0596 74FF               MOV     A,#-1
0598 D3                 SETB    C
0599 22                 RET
                VPF20:
059A 7401               MOV     A,#1
059C C3                 CLR     C
059D 22                 RET

059E E527               MOV     A,SAMPLE
05A0 C3                 CLR     C
05A1 954D               SUBB    A,MIN_PULSE
05A3 600E               JZ      VP1
05A5 4022               JC      VP10    ; LESS THAN
05A7 E527               MOV     A,SAMPLE
05A9 C3                 CLR     C
05AA 954B               SUBB    A,MAX_PULSE
05AC 6005               JZ      VP1
05AE 501D               JNC     VP20    ; GREATER THAN
05B0 0205C5             LJMP    VP5     ; EQU
                VP1:
05B3 E528               MOV     A,SAMPLE+1
05B5 C3                 CLR     C
05B6 954E               SUBB    A,MIN_PULSE+1
05B8 600B               JZ      VP5
05BA 400D               JC      VP10
05BC E528               MOV     A,SAMPLE+1
05BE C3                 CLR     C
05BF 954C               SUBB    A,MAX_PULSE+1
05C1 6002               JZ      VP5
05C3 5008               JNC     VP20
                VP5:
05C5 7400               MOV     A,#0
```

```
05C7 C3                 CLR     C
05C8 22                 RET
                VP10:
05C9 74FF               MOV     A,#-1
05CB D3                 SETB    C
05CC 22                 RET
                VP20:
05CD 7401               MOV     A,#1
05CF C3                 CLR     C
05D0 22                 RET

                VALIDATE_FREQ:
05D1 E52F               MOV     A,SAMPLE_TIME+1
05D3 C3                 CLR     C
05D4 9536               SUBB    A,TEST_TIME+1
05D6 F531               MOV     SAMPLE_FREQ+1,A
05D8 E52E               MOV     A,SAMPLE_TIME
05DA 9535               SUBB    A,TEST_TIME
05DC F530               MOV     SAMPLE_FREQ,A

05DE E530               MOV     A,SAMPLE_FREQ
05E0 C3                 CLR     C
05E1 9549               SUBB    A,MIN_FREQ
05E3 600E               JZ      VF1
05E5 4022               JC      VF10    ; LESS THAN
05E7 E530               MOV     A,SAMPLE_FREQ
05E9 C3                 CLR     C
05EA 9547               SUBB    A,MAX_FREQ
05EC 6005               JZ      VF1
05EE 501D               JNC     VF20    ; GREATER THAN
05F0 020605             LJMP    VF5     ; EQ
                VF1:
05F3 E531               MOV     A,SAMPLE_FREQ+1
05F5 C3                 CLR     C
05F6 954A               SUBB    A,MIN_FREQ+1
05F8 600B               JZ      VF5
05FA 400D               JC      VF10
05FC E531               MOV     A,SAMPLE_FREQ+1
05FE C3                 CLR     C
05FF 9548               SUBB    A,MAX_FREQ+1
0601 6002               JZ      VF5
0603 5008               JNC     VF20
                VF5:
0605 7400               MOV     A,#0
0607 C3                 CLR     C
0608 22                 RET
                VF10:
0609 74FF               MOV     A,#-1
060B D3                 SETB    C
060C 22                 RET
                VF20:
060D 7401               MOV     A,#1
060F C3                 CLR     C
0610 22                 RET


                SET_SUTO_FREQ:
0611 E536               MOV     A,TEST_TIME+1
0613 C3                 CLR     C
0614 3538               ADDC    A,TEST_FREQ+1
0616 F536               MOV     TEST_TIME+1,A
0618 E535               MOV     A,TEST_TIME
061A 3537               ADDC    A,TEST_FREQ
061C F535               MOV     TEST_TIME,A
061E 22                 RET

                DISPLAY_FREQ:
061F E525               MOV     A,TABLE_ADDR
0621 F583               MOV     DPH,A
0623 E526               MOV     A,TABLE_ADDR+1
0625 F582               MOV     DPL,A
0627 7A08               MOV     R2,#8   ; LAMP COUNT
0629 7B00               MOV     R3,#0   ; TABLE OFFSET
062B 7C00               MOV     R4,#00H ; LAMP BIT
                LAMP_TEST_LOOP:
062D EB                 MOV     A,R3
062E 04                 INC     A
062F 93                 MOVC    A,@A+DPTR
0630 C3                 CLR     C
0631 33                 RLC     A
```

```
0632 EB          MOV     A,R3
0633 93          MOVC    A,@A+DPTR
0634 33          RLC     A
0635 C3          CLR     C
0636 954F        SUBB    A,FINAL_FREQ
0638 6005        JZ      TEST_LOW_BYTE
063A 500F        JNC     MATCH_FOUND
063C 020665      LJMP    TEST_NEXT
                 TEST_LOW_BYTE:
063F EB          MOV     A,R3
0640 04          INC     A
0641 93          MOVC    A,@A+DPTR
0642 C3          CLR     C
0643 33          RLC     A
0644 C3          CLR     C
0645 9550        SUBB    A,FINAL_FREQ+1
0647 601C        JZ      TEST_NEXT
0649 401A        JC      TEST_NEXT
                 MATCH_FOUND:
064B 7461        MOV     A,#TEST_ARRAY
064D 252B        ADD     A,CUR_COUNT
064F F8          MOV     R0,A
0650 A604        MOV     @R0,R4
0652 052B        INC     CUR_COUNT
0654 E52B        MOV     A,CUR_COUNT
0656 B40A06      CJNE    A,#10,COUNT_OK
0659 752B00      MOV     CUR_COUNT,#0
065C 020677      LJMP    SAMPLE_TEST_OUT
                 COUNT_OK:
065F B52215      CJNE    A,SAMPLE_COUNT,SAMPLE_TEST_OUT
0662 02067A      LJMP    DISPLAY_RESULTS

                 TEST_NEXT:
0665 0B          INC     R3
0666 0B          INC     R3
0667 EC          MOV     A,R4
0668 23          RL      A
0669 7002        JNZ     NOT_PLUS40
066B 7401        MOV     A,#1
                 NOT_PLUS40:
066D FC          MOV     R4,A
066E 1A          DEC     R2
066F EA          MOV     A,R2
0670 70BB        JNZ     LAMP_TEST_LOOP
0672 7C80        MOV     R4,#080H        ; - 40
0674 02064B      LJMP    MATCH_FOUND

                 SAMPLE_TEST_OUT:
0677 020145      LJMP    KB_SCAN_LOOP

                 DISPLAY_RESULTS:
067A 752900      MOV     TEST_CODE,#0
067D 7B09        MOV     R3,#9
                 OUTER_LOOP:
067F 7C00        MOV     R4,#0
0681 AD22        MOV     R5,SAMPLE_COUNT
0683 7861        MOV     R0,#TEST_ARRAY
                 INNER_LOOP:
0685 E6          MOV     A,@R0
0686 B52901      CJNE    A,TEST_CODE,NOT_EQUAL
0689 0C          INC     R4
                 NOT_EQUAL:
068A 08          INC     R0
068B 1D          DEC     R5
068C BD00F6      CJNE    R5,#0,INNER_LOOP
068F EC          MOV     A,R4
0690 C3          CLR     C
0691 9523        SUBB    A,MATCH_COUNT
0693 6015        JZ      FOUND_IT
0695 5013        JNC     FOUND_IT
0697 E529        MOV     A,TEST_CODE
0699 23          RL      A
069A 7002        JNZ     CODE_NOT_ZERO
069C 7401        MOV     A,#1
                 CODE_NOT_ZERO:
069E F529        MOV     TEST_CODE,A
06A0 1B          DEC     R3
06A1 BB00DB      CJNE    R3,#0,OUTER_LOOP
```

```
06A4 752B00          MOV     CUR_COUNT,#0
06A7 02014F          LJMP    NOT_READY
                FOUND_IT:
06AA E52A            MOV     A,OLD_CODE
06AC 2401            ADD     A,#1
06AE 601D            JZ      FI10
06B0 E52A            MOV     A,OLD_CODE
06B2 C3              CLR     C
06B3 9529            SUBB    A,TEST_CODE
06B5 6016            JZ      FI10
06B7 4008            JC      FILT
06B9 C3              CLR     C
06BA E52A            MOV     A,OLD_CODE
06BC 13              RRC     A
06BD F529            MOV     TEST_CODE,A
06BF 800C            SJMP    FI10
                FILT:
06C1 E52A            MOV     A,OLD_CODE
06C3 7004            JNZ     FILT1
06C5 7401            MOV     A,#1
06C7 8004            SJMP    FI10
                FILT1:
06C9 C3              CLR     C
06CA 33              RLC     A
06CB F529            MOV     TEST_CODE,A
                FI10:
06CD 85292A          MOV     OLD_CODE,TEST_CODE
06D0 E520            MOV     A,P3_IMAGE      ; CLEAR CENTER LAMP
06D2 4403            ORL     A,#3
06D4 F520            MOV     P3_IMAGE,A
06D6 D2B0            SETB    0B0H
06D8 D2B1            SETB    0B1H
06DA E529            MOV     A,TEST_CODE

06DC 6022            JZ      PLUS_40
06DE 54F0            ANL     A,#0F0H
06E0 7007            JNZ     NO_FIXUP
06E2 E529            MOV     A,TEST_CODE
06E4 23              RL      A
06E5 540F            ANL     A,#0FH
06E7 601B            JZ      SET_CENTER_LAMP
                NO_FIXUP:
06E9 F4              CPL     A
06EA F590            MOV     P1,A
06EC F51E            MOV     P1_IMAGE,A
06EE 752B00          MOV     CUR_COUNT,#0    ; RESET COUNT
06F1 751D10          MOV     K1SEC,#16
06F4 751A01          MOV     TONE_COUNT,#TONE_TIME
06F7 751900          MOV     LIGHT_COUNT,#0
06FA 751819          MOV     SLEEP_COUNT,#SLEEP_TIME
06FD 02014F          LJMP    NOT_READY
                PLUS_40:
0700 7401            MOV     A,#1
0702 80E5            SJMP    NO_FIXUP
                SET_CENTER_LAMP:
0704 E520            MOV     A,P3_IMAGE
0706 54FC            ANL     A,#0FCH
0708 F520            MOV     P3_IMAGE,A
070A C2B0            CLR     0B0H
070C C2B1            CLR     0B1H
070E 7400            MOV     A,#0
0710 80D7            SJMP    NO_FIXUP


                INTERUPT_1:
0712 32              RETI

                TIMER1_INTERUPT:        ; 1 MS TIMER INTERUPT
0713 C0D0            PUSH    PSW
0715 C0E0            PUSH    ACC
0717 D2D4            SETB    RS1
0719 751B00          MOV     KB_SCAN_COUNT,#0
071C 151D            DEC     K1SEC
071E E51D            MOV     A,K1SEC
0720 B40031          CJNE    A,#0,TIMER1_OUT
0723 751D10          MOV     K1SEC,#16
0726 1518            DEC     SLEEP_COUNT
0728 E518            MOV     A,SLEEP_COUNT
072A 602D            JZ      GO_TO_SLEEP
072C E519            MOV     A,LIGHT_COUNT
072E 600B            JZ      TEST TONE
```

```
0730 1519          DEC     LIGHT_COUNT
0732 B4011F        CJNE    A,#1,TIMER1_OUT
0735 751EFF        MOV     P1_IMAGE,#0FFH
0738 7590FF        MOV     P1,#0FFH
                TEST_TONE:
073B E51A          MOV     A,TONE_COUNT
073D 6015          JZ      TIMER1_OUT
073F 151A          DEC     TONE_COUNT

0741 B40110        CJNE    A,#1,TIMER1_OUT
0744 751EFF        MOV     P1_IMAGE,#0FFH
0747 7590FF        MOV     P1,#0FFH
074A E520          MOV     A,P3_IMAGE
074C 4403          ORL     A,#03H
074E F520          MOV     P3_IMAGE,A
0750 D2B0          SETB    0B0H
0752 D2B1          SETB    0B1H
                TIMER1_OUT:
0754 D0E0          POP     ACC
0756 D0D0          POP     PSW
0758 32            RETI

                GO_TO_SLEEP:
0759 7590FF        MOV     P1,#0FFH
075C 751EFF        MOV     P1_IMAGE,#0FFH
075F 75B0FF        MOV     P3,#0FFH
0762 7520FF        MOV     P3_IMAGE,#0FFH
0765 75A800        MOV     IE,#0
0768 F2            MOVX    @R0,A    ; TURN OFF POWER
0769 758702        MOV     PCON,#02H        ; POWER DOWN
076C D0E0          POP     ACC
076E D0D0          POP     PSW
0770 7400          MOV     A,#00    ; LOW ADDR BYTE
0772 C0E0          PUSH    ACC
0774 7401          MOV     A,#01H
0776 C0E0          PUSH    ACC      ; LOC 100 FOR RESTART
0778 32            RETI

                INTERUPT_0:
0779 C0D0          PUSH    PSW
077B C0E0          PUSH    ACC
077D D2D3          SETB    RS0
                IO_10:
077F A82D          MOV     R0,SAMPLE_INDEX
0781 AD8B          MOV     R5,TL1
0783 AC8D          MOV     R4,TH1
0785 ED            MOV     A,R5
0786 2402          ADD     A,#2
0788 40F5          JC      IO_10
078A AB8A          MOV     R3,TL0
078C AA8C          MOV     R2,TH0
078E EA            MOV     A,R2
078F 7006          JNZ     IO_20
0791 EB            MOV     A,R3
0792 C3            CLR     C
0793 9414          SUBB    A,#20
0795 400E          JC      IO_50
                IO_20:
0797 CC            XCH     A,R4
0798 F6            MOV     @R0,A
0799 CD            XCH     A,R5
079A 08            INC     R0
079B F6            MOV     @R0,A
079C CA            XCH     A,R2
079D 08            INC     R0
079E B86002        CJNE    R0,#SAMPLE_ARRAY_END,IR01
07A1 7856          MOV     R0,#SAMPLE_ARRAY
                IR01:
07A3 882D          MOV     SAMPLE_INDEX,R0
                IO_50:
07A5 758C00        MOV     TH0,#0
07A8 758A00        MOV     TL0,#0   ; RESET TIMER
07AB D0E0          POP     ACC
07AD D0D0          POP     PSW
07AF 32            RETI

                TIMER0_INTERUPT:
07B0 32            RETI

                SERIAL_INTERUPT:
07B1 32            RETI
```

```
                ;%E     END OF SIMULATION
                TABLES:
07B2 0864               DW      DUMMY   ; TABLE0 6 STRING FULL
07B4 0864               DW      TABLE1
07B6 0869               DW      TABLE2
07B8 086E               DW      TABLE3
07BA 0873               DW      TABLE4
07BC 087B               DW      TABLE5
07BE 087D               DW      TABLE6
07C0 0864               DW      DUMMY   ; TABLE7
07C2 0864               DW      DUMMY   ; TABLE8 6 STRING -1
07C4 0882               DW      TABLE9
07C6 0887               DW      TABLE10
07C8 088C               DW      TABLE11
07CA 0891               DW      TABLE12
07CC 0896               DW      TABLE13
07CE 089B               DW      TABLE14
07D0 0864               DW      DUMMY   ; TABLE15
07D2 0864               DW      DUMMY   ; TABLE16 6 STRING -2
07D4 08A0               DW      TABLE17
07D6 08A5               DW      TABLE18
07D8 08AA               DW      TABLE19
07DA 08AF               DW      TABLE20
07DC 08B4               DW      TABLE21
07DE 08B9               DW      TABLE22
07E0 0864               DW      DUMMY   ; TABLE23
07E2 0864               DW      DUMMY   ; DUMMY - 3
07E4 0864               DW      DUMMY
07E6 0864               DW      DUMMY
07E8 0864               DW      DUMMY
07EA 0864               DW      DUMMY
07EC 0864               DW      DUMMY
07EE 0864               DW      DUMMY
07F0 0864               DW      DUMMY   ; END OF DUMMY TABLE
07F2 0864               DW      DUMMY   ; TABLE24 5 STRING FULL
07F4 08BE               DW      TABLE25
07F6 08C3               DW      TABLE26
07F8 08C8               DW      TABLE27
07FA 08CD               DW      TABLE28
07FC 08D2               DW      TABLE29
07FE 0864               DW      DUMMY   ; TABLE30
0800 0864               DW      DUMMY   ; TABLE31
0802 0864               DW      DUMMY   ; TABLE32 5 STRING -1
0804 08D7               DW      TABLE33
0806 08DC               DW      TABLE34
0808 08E1               DW      TABLE35
080A 08E6               DW      TABLE36
080C 08EB               DW      TABLE37
080E 0864               DW      DUMMY   ; TABLE38
0810 0864               DW      DUMMY   ; TABLE39
0812 0864               DW      DUMMY   ; TABLE40 5 STRING -2
0814 08F0               DW      TABLE41
0816 08F5               DW      TABLE42
0818 08FA               DW      TABLE43
081A 08FF               DW      TABLE44
081C 0904               DW      TABLE45
081E 0864               DW      DUMMY   ; TABLE46
0820 0864               DW      DUMMY   ; TABLE47
0822 0864               DW      DUMMY   ; DUMMY - 3
0824 0864               DW      DUMMY
0826 0864               DW      DUMMY
0828 0864               DW      DUMMY
082A 0864               DW      DUMMY
082C 0864               DW      DUMMY
082E 0864               DW      DUMMY
0830 0864               DW      DUMMY   ; END OF DUMMY TABLE
0832 0864               DW      DUMMY   ; TABLE48 4 STRING FULL
0834 0909               DW      TABLE49
0836 090E               DW      TABLE50
0838 0913               DW      TABLE51
083A 0918               DW      TABLE52
083C 0864               DW      DUMMY   ; TABLE53
083E 0864               DW      DUMMY   ; TABLE54
0840 0864               DW      DUMMY   ; TABLE55
0842 0864               DW      DUMMY   ; TABLE56 4 STRING -1
0844 091D               DW      TABLE57
0846 0922               DW      TABLE58
0848 0927               DW      TABLE59
084A 092C               DW      TABLE60
084C 0864               DW      DUMMY   ; TABLE61
```

```
084E 0864          DW      DUMMY    ; TABLE62
0850 0864          DW      DUMMY    ; TABLE63
0852 0864          DW      DUMMY    ; TABLE64 4 STRING -2
0854 0931          DW      TABLE65
0856 0936          DW      TABLE66
0858 093B          DW      TABLE67
085A 0940          DW      TABLE68
085C 0864          DW      DUMMY    ; TABLE69
085E 0864          DW      DUMMY    ; TABLE70
0860 0864          DW      DUMMY    ; TABLE71
0862 0864          DW      DUMMY    ; TABLE72

                DUMMY:

                TABLE1:                     ; 6 STRING FULL
0864 06                DB      6
0865 03                DB      3
0866 00                DB      0
0867 0945              DW      XTABLE1

                TABLE2:
0869 06                DB      6
086A 03                DB      3
086B 01                DB      1
086C 0955              DW      XTABLE2

                TABLE3:
086E 06                DB      6
086F 03                DB      3
0870 02                DB      2
0871 0965              DW      XTABLE3

                TABLE4:
0873 06                DB      6
0874 03                DB      3
0875 03                DB      3
0876 0975              DW      XTABLE4

                TABLE5:
0878 06                DB      6
0879 03                DB      3
087A 04                DB      4
087B 0985              DW      XTABLE5

                TABLE6:
087D 06                DB      6
087E 03                DB      3
087F 05                DB      5
0880 0995              DW      XTABLE6

                TABLE9:                     ; 6 STRING -1
0882 06                DB      6
0883 03                DB      3
0884 00                DB      0
0885 09A5              DW      XTABLE9

                TABLE10:
0887 06                DB      6
0888 03                DB      3
0889 01                DB      1
088A 09B5              DW      XTABLE10

                TABLE11:
088C 06                DB      6
088D 03                DB      3
088E 02                DB      2
088F 09C5              DW      XTABLE11

                TABLE12:
0891 06                DB      6
0892 03                DB      3
0893 03                DB      3
0894 09D5              DW      XTABLE12

                TABLE13:
0896 06                DB      6
0897 03                DB      3
0898 04                DB      4
0899 09E5              DW      XTABLE13
```

```
                TABLE14:
089B 06                 DB      6
089C 03                 DB      3
089D 05                 DB      5
089E 09F5               DW      XTABLE14

                TABLE17:                                ; 6 STRING -2
08A0 06                 DB      6
08A1 03                 DB      3
08A2 00                 DB      0
08A3 0A05               DW      XTABLE17

                TABLE18:
08A5 06                 DB      6
08A6 03                 DB      3
08A7 01                 DB      1
08A8 0A15               DW      XTABLE18

                TABLE19:
08AA 06                 DB      6
08AB 03                 DB      3
08AC 02                 DB      2
08AD 0A25               DW      XTABLE19

                TABLE20:
08AF 06                 DB      6
08B0 03                 DB      3
08B1 03                 DB      3
08B2 0A35               DW      XTABLE20

                TABLE21:
08B4 06                 DB      6
08B5 03                 DB      3
08B6 04                 DB      4
08B7 0A45               DW      XTABLE21

                TABLE22:
08B9 06                 DB      6
08BA 03                 DB      3
08BB 05                 DB      5
08BC 0A55               DW      XTABLE22

                TABLE25:                                ; 5 STRING FULL
08BE 06                 DB      6
08BF 03                 DB      3
08C0 00                 DB      0
08C1 0A65               DW      XTABLE25

                TABLE26:
08C3 06                 DB      6
08C4 03                 DB      3
08C5 01                 DB      1
08C6 0A75               DW      XTABLE26

                TABLE27:
08C8 06                 DB      6
08C9 03                 DB      3
08CA 02                 DB      2
08CB 0A85               DW      XTABLE27

                TABLE28:
08CD 06                 DB      6
08CE 03                 DB      3
08CF 03                 DB      3
08D0 0A95               DW      XTABLE28

                TABLE29:
08D2 06                 DB      6
08D3 03                 DB      3
08D4 04                 DB      4
08D5 0AA5               DW      XTABLE29

                TABLE33:                                ; 5 STRING -1
08D7 06                 DB      6
08D8 03                 DB      3
```

```
08D9 00          DB      0
08DA 0AB5        DW      XTABLE33

                 TABLE34:
08DC 06          DB      6
08DD 03          DB      3
08DE 01          DB      1
08DF 0AC5        DW      XTABLE34

                 TABLE35:
08E1 06          DB      6
08E2 03          DB      3
08E3 02          DB      2
08E4 0AD5        DW      XTABLE35

                 TABLE36:
08E6 06          DB      6
08E7 03          DB      3
08E8 03          DB      3
08E9 0AE5        DW      XTABLE36

                 TABLE37:
08EB 06          DB      6
08EC 03          DB      3
08ED 04          DB      4
08EE 0AF5        DW      XTABLE37

                 TABLE41:                        ; 5 STRING -2
08F0 06          DB      6
08F1 03          DB      3
08F2 00          DB      0
08F3 0B05        DW      XTABLE41

                 TABLE42:
08F5 06          DB      6
08F6 03          DB      3
08F7 01          DB      1
08F8 0B15        DW      XTABLE42

                 TABLE43:
08FA 06          DB      6
08FB 03          DB      3
08FC 02          DB      2
08FD 0B25        DW      XTABLE43

                 TABLE44:
08FF 06          DB      6
0900 03          DB      3
0901 03          DB      3
0902 0B35        DW      XTABLE44

                 TABLE45:
0904 06          DB      6
0905 03          DB      3
0906 04          DB      4
0907 0B45        DW      XTABLE45

                 TABLE49:                        ; 4 STRING FULL
0909 06          DB      6
090A 03          DB      3
090B 00          DB      0
090C 0B55        DW      XTABLE49

                 TABLE50:
090E 06          DB      6
090F 03          DB      3
0910 01          DB      1
0911 0B65        DW      XTABLE50

                 TABLE51:
0913 06          DB      6
0914 03          DB      3
0915 02          DB      2
0916 0B75        DW      XTABLE51
```

```
                TABLE52:
0918 06                 DB      6
0919 03                 DB      3
091A 03                 DB      3
091B 0B85               DW      XTABLE52

                TABLE57:                                ; 4 STRING -1
091D 06                 DB      6
091E 03                 DB      3
091F 00                 DB      0
0920 0B95               DW      XTABLE57

                TABLE58:
0922 06                 DB      6
0923 03                 DB      3
0924 01                 DB      1
0925 0BA5               DW      XTABLE58

                TABLE59:
0927 06                 DB      6
0928 03                 DB      3
0929 02                 DB      2
092A 0BB5               DW      XTABLE59

                TABLE60:
092C 06                 DB      6
092D 03                 DB      3
092E 03                 DB      3
092F 0BC5               DW      XTABLE60

                TABLE65:                                ; 4 STRING -2
0931 06                 DB      6
0932 03                 DB      3
0933 00                 DB      0
0934 0BD5               DW      XTABLE65

                TABLE66:
0936 06                 DB      6
0937 03                 DB      3
0938 01                 DB      1
0939 0BE5               DW      XTABLE66

                TABLE67:
093B 06                 DB      6
093C 03                 DB      3
093D 02                 DB      2
093E 0BF5               DW      XTABLE67

                TABLE68:
0940 06                 DB      6
0941 03                 DB      3
0942 03                 DB      3
0943 0C05               DW      XTABLE68


                XTABLE1:
0945 1729               DW      1729H   ;+40C   ;E2
0947 176E               DW      176EH   ;+20C
0949 1791               DW      1791H   ;+10C
094B 17A2               DW      17A2H   ;+5C
                ;       DW      17B3H   ;ON
094D 17C5               DW      17C5H   ;-5C
094F 17D7               DW      17D7H   ;-10C
0951 17FA               DW      17FAH   ;-20C
0953 1841               DW      1841H   ;-40C

                XTABLE2:
0955 115A               DW      115AH   ;+40C   ;A2
0957 118D               DW      118DH   ;+20C
0959 11A7               DW      11A7H   ;+10C
095B 11B4               DW      11B4H   ;+5C
                ;       DW      11C1H   ;ON
095D 11CF               DW      11CFH   ;-5C
095F 11DC               DW      11DCH   ;-10C
0961 11F6               DW      11F6H   ;-20C
0963 122C               DW      122CH   ;-40C
```

```
                XTABLE3:
0965 0CFF               DW      0CFFH   ;+40C   ;D3
0967 0D26               DW      0D26H   ;+20C
0969 0D3A               DW      0D3AH   ;+10C
096B 0D43               DW      0D43H   ;+5C
                ;       DW      0D4DH   ;ON
096D 0D57               DW      0D57H   ;-5C
096F 0D61               DW      0D61H   ;-10C
0971 0D75               DW      0D75H   ;-20C
0973 0D9D               DW      0D9DH   ;-40C
                ;

                XTABLE4:
0975 09BD               DW      09BDH   ;+40C   ;G3
0977 09DA               DW      09DAH   ;+20C
0979 09E8               DW      09E8H   ;+10C

097B 09F0               DW      09F0H   ;+5C
                ;       DW      09F7H   ;ON
097D 09FE               DW      09FEH   ;-5C
097F 0A06               DW      0A06H   ;-10C
0981 0A15               DW      0A15H   ;-20C
0983 0A33               DW      0A33H   ;-40C

                XTABLE5:
0985 07BB               DW      07BBH   ;+40C   ;B3
0987 07D2               DW      07D2H   ;+20C
0989 07DD               DW      07DDH   ;+10C
098B 07E3               DW      07E3H   ;+5C
                ;       DW      07E9H   ;ON
098D 07EF               DW      07EFH   ;-5C
098F 07F4               DW      07F4H   ;-10C
0991 0800               DW      0800H   ;-20C
0993 0818               DW      0818H   ;-40C

                XTABLE6:
0995 05CA               DW      05CAH   ;+40C   ;E4
0997 05DB               DW      05DBH   ;+20C
0999 05E4               DW      05E4H   ;+10C
099B 05E8               DW      05E8H   ;+5C
                ;       DW      05EDH   ;ON
099D 05F1               DW      05F1H   ;-5C
099F 05F6               DW      05F6H   ;-10C
09A1 05FE               DW      05FEH   ;-20C
09A3 0610               DW      0610H   ;-40C

                XTABLE9:
09A5 1889               DW      1889H   ;+40C   ;E2
09A7 18D2               DW      18D2H   ;+20C
09A9 18F7               DW      18F7H   ;+10C
09AB 190A               DW      190AH   ;+5C
                ;       DW      191CH   ;ON
09AD 192F               DW      192FH   ;-5C
09AF 1941               DW      1941H   ;-10C
09B1 1967               DW      1967H   ;-20C
09B3 19B2               DW      19B2H   ;-40C

                XTABLE10:
09B5 1262               DW      1262H   ;+40C   ;A2
09B7 1298               DW      1298H   ;+20C
09B9 12B4               DW      12B4H   ;+10C
09BB 12C2               DW      12C2H   ;+5C
                ;       DW      12D0H   ;ON
09BD 12DE               DW      12DEH   ;-5C
09BF 12EC               DW      12ECH   ;-10C
09C1 1308               DW      1308H   ;-20C
09C3 1340               DW      1340H   ;-40C

                XTABLE11:
09C5 0DC5               DW      0DC5H   ;+40C   ;D3
09C7 0DEE               DW      0DEEH   ;+20C

09C9 0E03               DW      0E03H   ;+10C
09CB 0E0D               DW      0E0DH   ;+5C
                ;       DW      0E18H   ;ON
09CD 0E22               DW      0E22H   ;-5C
09CF 0E2D               DW      0E2DH   ;-10C
09D1 0E42               DW      0E42H   ;-20C
09D3 0E6C               DW      0E6CH   ;-40C
```

```
                XTABLE12:
09D5 0A51               DW      0A51H   ;+40C   ;G3
09D7 0A70               DW      0A70H   ;+20C
09D9 0A7F               DW      0A7FH   ;+10C
09DB 0A87               DW      0A87H   ;+5C
                ;       DW      0A8FH   ;ON
09DD 0A97               DW      0A97H   ;-5C
09DF 0A9E               DW      0A9EH   ;-10C
09E1 0AAE               DW      0AAEH   ;-20C
09E3 0ACE               DW      0ACEH   ;-40C

                XTABLE13:
09E5 0830               DW      0830H   ;+40C   ;B3
09E7 0849               DW      0849H   ;+20C
09E9 0855               DW      0855H   ;+10C
09EB 085B               DW      085BH   ;+5C
                ;       DW      0861H   ;ON
09ED 0867               DW      0867H   ;-5C
09EF 086E               DW      086EH   ;-10C
09F1 087A               DW      087AH   ;-20C
09F3 0893               DW      0893H   ;-40C

                XTABLE14:
09F5 0622               DW      0622H   ;+40C   ;E4
09F7 0635               DW      0635H   ;+20C
09F9 063E               DW      063EH   ;+10C
09FB 0642               DW      0642H   ;+5C
                ;       DW      0647H   ;ON
09FD 064C               DW      064CH   ;-5C
09FF 0650               DW      0650H   ;-10C
0A01 065A               DW      065AH   ;-20C
0A03 066D               DW      066DH   ;-40C

                XTABLE17:
0A05 1A01               DW      1A01H   ;+40C   ;E2
0A07 1A4C               DW      1A4CH   ;+20C
0A09 1A73               DW      1A73H   ;+10C
0A0B 1A87               DW      1A87H   ;+5C
                ;       DW      1A9AH   ;ON
0A0D 1AAE               DW      1AAEH   ;-5C
0A0F 1AC2               DW      1AC2H   ;-10C
0A11 1AEA               DW      1AEAH   ;-20C
0A13 1B3A               DW      1B3AH   ;-40C

                XTABLE18:
0A15 137A               DW      137AH   ;+40C   ;A2
0A17 13B3               DW      13B3H   ;+20C
0A19 13D1               DW      13D1H   ;+10C
0A1B 13DF               DW      13DFH   ;+5C
                ;       DW      13EEH   ;ON
0A1D 13FD               DW      13FDH   ;-5C
0A1F 140C               DW      140CH   ;-10C
0A21 1429               DW      1429H   ;-20C
0A23 1465               DW      1465H   ;-40C

                XTABLE19:
0A25 0E97               DW      0E97H   ;+40C   ;D3
0A27 0EC2               DW      0EC2H   ;+20C
0A29 0ED8               DW      0ED8H   ;+10C
0A2B 0EE3               DW      0EE3H   ;+5C
                ;       DW      0EEEH   ;ON
0A2D 0EF9               DW      0EF9H   ;-5C
0A2F 0F04               DW      0F04H   ;-10C
0A31 0F1B               DW      0F1BH   ;-20C
0A33 0F48               DW      0F48H   ;-40C

                XTABLE20:
0A35 0AEE               DW      0AEEH   ;+40C   ;G3
0A37 0B0F               DW      0B0FH   ;+20C
0A39 0B1F               DW      0B1FH   ;+10C
0A3B 0B27               DW      0B27H   ;+5C
                ;       DW      0B2FH   ;ON
0A3D 0B38               DW      0B38H   ;-5C
0A3F 0B40               DW      0B40H   ;-10C
0A41 0B51               DW      0B51H   ;-20C
0A43 0B72               DW      0B72H   ;-40C
```

```
                XTABLE21:
0A45 08AD               DW      08ADH   ;+40C   ;B3
0A47 08C7               DW      08C7H   ;+20C
0A49 08D4               DW      08D4H   ;+10C
0A4B 08DA               DW      08DAH   ;+5C
                ;       DW      08E1H   ;ON
0A4D 08E7               DW      08E7H   ;-5C
0A4F 08EE               DW      08EEH   ;-10C
0A51 08FB               DW      08FBH   ;-20C
0A53 0916               DW      0916H   ;-40C

                XTABLE22:
0A55 0680               DW      0680H   ;+40C   ;E4
0A57 0693               DW      0693H   ;+20C
0A59 069D               DW      069DH   ;+10C
0A5B 06A2               DW      06A2H   ;+5C
                ;       DW      06A7H   ;ON
0A5D 06AC               DW      06ACH   ;-5C
0A5F 06B0               DW      06B0H   ;-10C
0A61 06BA               DW      06BAH   ;-20C
0A63 06CE               DW      06CEH   ;-40C

                ;FIVE STRING TABLE
                XTABLE25:
0A65 1EEA               DW      1EEAH   ;+40C   ;B1
0A67 1F46               DW      1F46H   ;+20C
0A69 1F74               DW      1F74H   ;+10C
0A6B 1F8C               DW      1F8CH   ;+5C
                ;       DW      1FA3H   ;ON
0A6D 1FBB               DW      1FBBH   ;-5C
0A6F 1FD2               DW      1FD2H   ;-10C
0A71 2001               DW      2001H   ;-20C
0A73 2060               DW      2060H   ;-40C

                ;
                XTABLE26:
0A75 1729               DW      1729H   ;+40C   ;E2
0A77 176E               DW      176EH   ;+20C
0A79 1791               DW      1791H   ;+10C
0A7B 17A2               DW      17A2H   ;+5C
                ;       DW      17B3H   ;ON
0A7D 17C5               DW      17C5H   ;-5C
0A7F 17D7               DW      17D7H   ;-10C
0A81 17FA               DW      17FAH   ;-20C
0A83 1841               DW      1841H   ;-40C

                ;
                XTABLE27:
0A85 115A               DW      115AH   ;+40C   ;A2
0A87 118D               DW      118DH   ;+20C
0A89 11A7               DW      11A7H   ;+10C
0A8B 11B4               DW      11B4H   ;+5C
                ;       DW      11C1H   ;ON
0A8D 11CF               DW      11CFH   ;-5C
0A8F 11DC               DW      11DCH   ;-10C
0A91 11F6               DW      11F6H   ;-20C
0A93 122C               DW      122CH   ;-40C

                ;
                XTABLE28:
0A95 0CFF               DW      0CFFH   ;+40C   ;D3
0A97 0D26               DW      0D26H   ;+20C
0A99 0D3A               DW      0D3AH   ;+10C
0A9B 0D43               DW      0D43H   ;+5C
                ;       DW      0D4DH   ;ON
0A9D 0D57               DW      0D57H   ;-5C
0A9F 0D61               DW      0D61H   ;-10C
0AA1 0D75               DW      0D75H   ;-20C
0AA3 0D9D               DW      0D9DH   ;-40C

                ;
                XTABLE29:
0AA5 09DB               DW      09DBH   ;+40C   ;G3
0AA7 09DA               DW      09DAH   ;+20C
0AA9 09E8               DW      09E8H   ;+10C
0AAB 09F0               DW      09F0H   ;+5C
                ;       DW      09F7H   ;ON
0AAD 09FE               DW      09FEH   ;-5C
0AAF 0A06               DW      0A06H   ;-10C
0AB1 0A15               DW      0A15H   ;-20C
0AB3 0A33               DW      0A33H   ;-40C

                ;FIVE STRING TABLE MINUS ONE TUNE
                XTABLE33:
0AB5 20C1               DW      20C1H   ;+40C   ;B1
0AB7 2122               DW      2122H   ;+20C
```

```
0AB9 2153          DW      2153H   ;+10C
0ABB 216C          DW      216CH   ;+5C
                ;  DW      2185H   ;ON
0ABD 219D          DW      219DH   ;-5C
0ABF 21B6          DW      21B6H   ;-10C
0AC1 21E8          DW      21E8H   ;-20C
0AC3 224D          DW      224DH   ;-40C
                ;
                XTABLE34:
0AC5 1889          DW      1889H   ;+40C   ;E2
0AC7 18D2          DW      18D2H   ;+20C
0AC9 18F7          DW      18F7H   ;+10C
0ACB 190A          DW      190AH   ;+5C
                ;  DW      191CH   ;ON
0ACD 192F          DW      192FH   ;-5C
0ACF 1941          DW      1941H   ;-10C
0AD1 1967          DW      1967H   ;-20C
0AD3 19B2          DW      19B2H   ;-40C
                ;
                XTABLE35:
0AD5 1262          DW      1262H   ;+40C   ;A2
0AD7 1298          DW      1298H   ;+20C
0AD9 12B4          DW      12B4H   ;+10C
0ADB 12C2          DW      12C2H   ;+5C
                ;  DW      12D0H   ;ON
0ADD 12DE          DW      12DEH   ;-5C
0ADF 12EC          DW      12ECH   ;-10C
0AE1 1308          DW      1308H   ;-20C
0AE3 1340          DW      1340H   ;-40C
                ;
                XTABLE36:
0AE5 0DC5          DW      0DC5H   ;+40C   ;D3
0AE7 0DEE          DW      0DEEH   ;+20C
0AE9 0E03          DW      0E03H   ;+10C
0AEB 0E0D          DW      0E0DH   ;+5C
                ;  DW      0E18H   ;ON
0AED 0E22          DW      0E22H   ;-5C
0AEF 0E2D          DW      0E2DH   ;-10C
0AF1 0E42          DW      0E42H   ;-20C
0AF3 0E6C          DW      0E6CH   ;-40C
                ;
                XTABLE37:
0AF5 0AEE          DW      0AEEH   ;+40C   ;G3
0AF7 0B0F          DW      0B0FH   ;+20C
0AF9 0B1F          DW      0B1FH   ;+10C
0AFB 0B27          DW      0B27H   ;+5C
                ;  DW      0B2FH   ;ON
0AFD 0B38          DW      0B38H   ;-5C
0AFF 0B40          DW      0B40H   ;-10C
0B01 0B51          DW      0B51H   ;-20C
0B03 0B72          DW      0B72H   ;-40C
                ;
                ;
                ;FIVE STRING TABLE MINUS 2 TUNE
                XTABLE41:
0B05 22B3          DW      22B3H   ;+40C   ;B1
0B07 231A          DW      231AH   ;+20C
0B09 234F          DW      234FH   ;+10C
0B0B 2369          DW      2369H   ;+5C
                ;  DW      2383H   ;ON
0B0D 239D          DW      239DH   ;-5C
0B0F 23B8          DW      23B8H   ;-10C
0B11 23ED          DW      23EDH   ;-20C
0B13 2457          DW      2457H   ;-40C

                XTABLE42:
0B15 1A01          DW      1A01H   ;+40C   ;E2
0B17 1A4C          DW      1A4CH   ;+20C
0B19 1A73          DW      1A73H   ;+10C
0B1B 1A87          DW      1A87H   ;+5C
                ;  DW      1A9AH   ;ON
0B1D 1AAE          DW      1AAEH   ;-5C
0B1F 1AC2          DW      1AC2H   ;-10C
0B21 1AEA          DW      1AEAH   ;-20C
0B23 1B3A          DW      1B3AH   ;-40C
                ;
                XTABLE43:
0B25 137A          DW      137AH   ;+40C   ;A2
0B27 13B3          DW      13B3H   ;+20C
0B29 13D1          DW      13D1H   ;+10C
0B2B 13DF          DW      13DFH   ;+5C
```

```
                ;       DW      13EEH   ;ON
0B2D 13FD               DW      13FDH   ;-5C
0B2F 140C               DW      140CH   ;-10C
0B31 1429               DW      1429H   ;-20C
0B33 1465               DW      1465H   ;-40C
                ;
                XTABLE44:
0B35 0E97               DW      0E97H   ;+40C   ;D3
0B37 0EC2               DW      0EC2H   ;+20C
0B39 0ED8               DW      0ED8H   ;+10C
0B3B 0EE3               DW      0EE3H   ;+5C
                ;       DW      0EEEH   ;ON
0B3D 0EF9               DW      0EF9H   ;-5C
0B3F 0F04               DW      0F04H   ;-10C
0B41 0F1B               DW      0F1BH   ;-20C
0B43 0F48               DW      0F48H   ;-40C
                ;
                XTABLE45:
0B45 0AEE               DW      0AEEH   ;+40C   ;G3
0B47 0B0F               DW      0B0FH   ;+20C
0B49 0B1F               DW      0B1FH   ;+10C
0B4B 0B27               DW      0B27H   ;+5C
                ;       DW      0B2FH   ;ON
0B4D 0B38               DW      0B38H   ;-5C
0B4F 0B40               DW      0B40H   ;-10C
0B51 0B51               DW      0B51H   ;-20C
0B53 0B72               DW      0B72H   ;-40C
                ;
                ;
                ;FOUR STRING TABLE
                XTABLE49:
0B55 2E51               DW      2E51H   ;+40C   ;E1
0B57 2EDC               DW      2EDCH   ;+20C
0B59 2F21               DW      2F21H   ;+10C
0B5B 2F44               DW      2F44H   ;+5C
                ;       DW      2F67H   ;ON
0B5D 2F8A               DW      2F8AH   ;-5C
0B5F 2FAD               DW      2FADH   ;-10C
0B61 2FF4               DW      2FF4H   ;-20C
0B63 3083               DW      3083H   ;-40C
                ;
                XTABLE50:
0B65 22B3               DW      22B3H   ;+40C   ;A1
0B67 231A               DW      231AH   ;+20C
0B69 234F               DW      234FH   ;+10C
0B6B 2369               DW      2369H   ;+5C
                ;       DW      2383H   ;ON
0B6D 239D               DW      239DH   ;-5C
0B6F 23B8               DW      23B8H   ;-10C
0B71 23ED               DW      23EDH   ;-20C
0B73 2457               DW      2457H   ;-40C
                ;
                XTABLE51:
0B75 19FF               DW      19FFH   ;+40C   ;D2
0B77 1A4C               DW      1A4CH   ;+20C
0B79 1A73               DW      1A73H   ;+10C
0B7B 1A87               DW      1A87H   ;+5C
                ;       DW      1A9AH   ;GN
0B7D 1AAE               DW      1AAEH   ;-5C
0B7F 1AC2               DW      1AC2H   ;-10C
0B81 1AEA               DW      1AEAH   ;-20C
0B83 1B3A               DW      1B3AH   ;-40C
                XTABLE52:
0B85 137A               DW      137AH   ;+40C   ;G2
0B87 13B3               DW      13B3H   ;+20C
0B89 13D1               DW      13D1H   ;+10C
0B8B 13DF               DW      13DFH   ;+5C
                ;       DW      13EEH   ;ON
0B8D 13FD               DW      13FDH   ;-5C
0B8F 140C               DW      140CH   ;-10C
0B91 1429               DW      1429H   ;-20C
0B93 1465               DW      1465H   ;-40C
                ;
                ;
                ;FOUR STRING TABLE MINUS ONE TUNE
                XTABLE57:
0B95 3113               DW      3113H   ;+40C   ;E1
0B97 31A5               DW      31A5H   ;+20C
```

```
0B99 31EE          DW      31EEH   ;+10C
0B9B 3213          DW      3213H   ;+5C
                ;  DW      3238H   ;ON
0B9D 325E          DW      325EH   ;-5C
0B9F 3283          DW      3283H   ;-10C
0BA1 32CE          DW      32CEH   ;-20C
0BA3 3365          DW      3365H   ;-40C
                ;
                XTABLE58:
0BA5 24C3          DW      24C3H   ;+40C    ;A1
0BA7 2531          DW      2531H   ;+20C
0BA9 2568          DW      2568H   ;+10C
0BAB 2584          DW      2584H   ;+5C
                ;  DW      259FH   ;ON
0BAD 25BB          DW      25BBH   ;-5C
0BAF 25D7          DW      25D7H   ;-10C
0BB1 260F          DW      260FH   ;-20C
0BB3 2681          DW      2681H   ;-40C
                ;
                XTABLE59:
0BB5 1B8B          DW      1B8BH   ;+40C    ;D2
0BB7 1BDD          DW      1BDDH   ;+20C
0BB9 1C06          DW      1C06H   ;+10C
0BBB 1C1B          DW      1C1BH   ;+5C
                ;  DW      1C2FH   ;ON
0BBD 1C44          DW      1C44H   ;-5C
0BBF 1C59          DW      1C59H   ;-10C
0BC1 1C83          DW      1C83H   ;-20C
0BC3 1CD8          DW      1CD8H   ;-40C
                ;
                XTABLE60:
0BC5 14A2          DW      14A2H   ;+40C    ;G2
0BC7 14DF          DW      14DFH   ;+20C
0BC9 14FE          DW      14FEH   ;+10C
0BCB 150E          DW      150EH   ;+5C
                ;  DW      151DH   ;ON
0BCD 152D          DW      152DH   ;-5C
0BCF 153D          DW      153DH   ;-10C
0BD1 155C          DW      155CH   ;-20C
0BD3 159C          DW      159CH   ;-40C
                ;

                ;FOUR STRING TABLE MINUS 2 TUNE
                XTABLE65:
0BD5 33FE          DW      33FEH   ;+40C    ;E1
0BD7 3499          DW      3499H   ;+20C
0BD9 34E7          DW      34E7H   ;+10C
0BDB 350E          DW      350EH   ;+5C
                ;  DW      3535H   ;ON
0BDD 355C          DW      355CH   ;-5C
0BDF 3584          DW      3584H   ;-10C
0BE1 35D3          DW      35D3H   ;-20C
0BE3 3673          DW      3673H   ;-40C
                ;
                XTABLE66:
0BE5 26F3          DW      26F3H   ;+40C    ;A1
0BE7 2767          DW      2767H   ;+20C
0BE9 27A1          DW      27A1H   ;+10C
0BEB 27BF          DW      27BFH   ;+5C
                ;  DW      27DCH   ;ON
0BED 27FA          DW      27FAH   ;-5C
0BEF 2817          DW      2817H   ;-10C
0BF1 2853          DW      2853H   ;-20C
0BF3 28CB          DW      28CBH   ;-40C
                ;
                XTABLE67:
0BF5 1D2E          DW      1D2EH   ;+40C    ;D2
0BF7 1D85          DW      1D85H   ;+20C
0BF9 1DB0          DW      1DB0H   ;+10C
0BFB 1DC6          DW      1DC6H   ;+5C
                ;  DW      1DDDH   ;ON
0BFD 1DF3          DW      1DF3H   ;-5C
0BFF 1E09          DW      1E09H   ;-10C
0C01 1E35          DW      1E35H   ;-20C
0C03 1EBF          DW      1EBFH   ;-40C
                ;
```

```
                XTABLE68:
0C05 15DC               DW      15DCH   ;+40C   ;G2
0C07 161D               DW      161DH   ;+20C
0C09 163E               DW      163EH   ;+10C
0C0B 164E               DW      164EH   ;+5C
                ;       DW      165FH   ;ON
0C0D 166F               DW      166FH   ;-5C
0C0F 1680               DW      1680H   ;-10C
0C11 16A1               DW      16A1H   ;-20C
0C13 16E5               DW      16E5H   ;-40C
                ;

0000                    END
```

| ;%T Symbol Name | Type | Value |
|---|---|---|
| AV_FREQ | D | 0044 |
| BASE_FREQ | D | 0040 |
| CLR_RAM | L | 010A |
| CODE_NOT_ZERO | L | 069E |
| COUNT_OK. | L | 065F |
| CUR_COUNT | D | 002B |
| CUR_TBL | D | 0021 |
| DISPLAY_FREQ. | L | [illegible] |
| DISPLAY_RESULTS | L | [illegible] |
| DUMMY | [illegible] | [illegible] |
| FFF_OUT | L | 0334 |
| FFP_OUT | L | 0335 |
| FFP_OUT1. | L | 033F |
| FF_OUT1 | L | 0364 |
| FI10. | L | 06CD |
| FILT. | L | 06C1 |
| FILT1 | L | 06C9 |
| FINAL_FREQ. | D | 004F |
| FIND_FIRST_FREQ | L | 0342 |
| FIND_FIRST_PULSE. | L | 0322 |
| FIND_NEXT_FREQ. | L | 0367 |
| FNF10 | L | 0393 |
| FNF15 | L | 039C |
| FNF5. | L | 037D |
| FNF7. | L | 0370 |
| FNF8. | L | 0383 |
| FNF_OUT | L | 037A |
| FOUND_IT. | L | 06AA |
| FREQ_COUNT. | D | 003A |
| FREQ_DELTA. | D | [illegible] |
| GO_TO_SLEEP | L | 0739 |
| GROUP_MASK. | [illegible] | [illegible] |
| HELPER. | [illegible] | [illegible] |
| HIGH_DELTA. | [illegible] | [illegible]053 |
| HUNT. | L | 02F0 |
| HUNT[illegible] | L | 0307 |
| [illegible] | L | 0313 |
| [illegible] | L | 0310 |
| HUNT_OUT. | L | 031F |
| IO_10 | L | 077F |
| IO_20 | L | 0797 |
| IO_50 | L | 07A5 |
| INNER_LOOP. | L | 0685 |
| INTERUPT_0. | L | 0779 |
| INTERUPT_1. | L | 0712 |
| IR01. | L | 07A3 |
| K100MS. | D | 001C |
| K1SEC | D | 001D |
| KB1 | L | 0176 |
| KB_SCAN_COUNT | D | 001B |
| KB_SCAN_LOOP. | L | 0145 |
| KEY_MASK. | I | 007E |
| KEY_TIME. | I | 0002 |
| LAMP_TEST_LOOP. | L | 062D |
| LIGHTS_ON | L | 0276 |
| LIGHT_COUNT | D | 0019 |
| LOW_DELTA | D | 0051 |
| LOW_POWER | L | 0295 |
| LOW_POWER_LOOP. | L | 029E |
| LPL1. | L | 02A1 |
| LPL2. | L | 02AB |
| MATCH_COUNT | D | 0023 |

| ;%T Symbol Name | Type | Value |
|---|---|---|
| MATCH_FOUND | L | 064B |
| MAX_FREQ. | D | 0047 |
| MAX_PULSE | D | 004B |
| MIN_FREQ. | D | 0049 |
| MIN_PULSE | D | 004D |
| MISSED_COUNT. | D | 0039 |
| NEW_TABLE | L | 01EC |
| NOT_0 | L | 01E1 |
| NOT_0A. | L | 01E6 |
| NOT_1 | L | 01BC |
| NOT_1A. | L | 01C1 |
| NOT_2 | L | 01A1 |
| NOT_2A. | L | 01A6 |
| NOT_EQUAL | L | 068A |
| NOT_PLUS40. | L | 066D |
| NOT_READY | L | 014F |
| NO_FIXUP. | L | 06E9 |
| OLD_CODE. | D | 002A |
| OUTER_LOOP. | L | 067F |
| P1_IMAGE. | D | 001E |
| P2_IMAGE. | D | 001F |
| P3_IMAGE. | D | 0020 |
| P3_SET. | L | 01D4 |
| PLUS_40 | L | 0700 |
| PULSE_DELTA | D | 003E |
| SAMPLE. | D | 0027 |
| SAMPLE_ARRAY. | D | 0056 |
| SAMPLE_ARRAY_END. | D | 0060 |
| SAMPLE_COUNT. | D | 0022 |
| SAMPLE_FREQ | D | 0030 |
| SAMPLE_INDEX. | D | 002D |
| SAMPLE_OUT. | D | 0055 |
| SAMPLE_READY_TEST | L | 02B4 |
| SAMPLE_STATUS | D | 002C |
| SAMPLE_TEST_OUT | L | 0677 |
| SAMPLE_TIME | D | 002E |
| SERIAL_INTERUPT | L | 07B1 |
| SET_CENTER_LAMP | L | 0704 |
| SET_FINAL_FREQ. | L | 049F |
| SET_FIRST_FREQ. | L | 03EF |
| SET_FREQ. | L | 0425 |
| SET_FREQ1 | L | 0475 |
| SET_PULSE | L | 03B6 |
| SET_SUTO_FREQ | L | 0611 |
| SET_TIME. | L | 03E8 |
| SF2 | L | 043D |
| SF3 | L | 0465 |
| SFF10 | L | 04E3 |
| SFF2. | L | 04B8 |
| SFF20 | L | 04EB |
| SFF30 | L | 050B |
| SFF5. | L | 04D9 |
| SFF50 | L | 0513 |
| SFF55 | L | 051D |
| SFF58 | L | 0525 |
| SFF60 | L | 053B |
| SFF70 | L | 0544 |
| SFF_GTR | L | 0550 |
| SFF_OUT | L | 054F |
| SF_6. | L | 047B |
| SLEEP_COUNT | D | 0018 |
| SLEEP_TIME. | I | 0019 |

| ;%T Symbol Name | Type | Value |
|---|---|---|
| SP_6. | L | 03C4 |
| SRT1. | L | 02C1 |
| STACK_BASE. | D | 006B |
| START | L | 0100 |
| TABLE1. | L | 0864 |
| TABLE10 | L | 0887 |
| TABLE11 | L | 088C |
| TABLE12 | L | 0891 |
| TABLE13 | L | 0896 |
| TABLE14 | L | 089B |
| TABLE17 | L | 08A0 |
| TABLE18 | L | 08A5 |
| TABLE19 | L | 08AA |
| TABLE2. | L | 0869 |
| TABLE20 | L | 08AF |
| TABLE21 | L | 08B4 |
| TABLE22 | L | 08B9 |
| TABLE25 | L | 08BE |
| TABLE26 | L | 08C3 |
| TABLE27 | L | 08C8 |
| TABLE28 | L | 08CD |
| TABLE29 | L | 08D2 |
| TABLE3. | L | 086E |
| TABLE33 | L | 08D7 |
| TABLE34 | L | 08DC |
| TABLE35 | L | 08E1 |
| TABLE36 | L | 08E6 |
| TABLE37 | L | 08EB |
| TABLE4. | L | 0873 |
| TABLE41 | L | 08F0 |
| TABLE42 | L | 08F5 |
| TABLE43 | L | 08FA |
| TABLE44 | L | 08FF |
| TABLE45 | L | 0904 |
| TABLE49 | L | 0909 |
| TABLE5. | L | 0878 |
| TABLE50 | L | 090E |
| TABLE51 | L | 0913 |
| TABLE52 | L | 0918 |
| TABLE57 | L | 091D |
| TABLE58 | L | 0922 |
| TABLE59 | L | 0927 |
| TABLE6. | L | 087D |
| TABLE60 | L | 092C |
| TABLE65 | L | 0931 |
| TABLE66 | L | 0936 |
| TABLE67 | L | 093B |

| ;%T Symbol Name | Type | Value |
|---|---|---|
| TABLE68 | L | 0940 |
| TABLE9. | L | 0882 |
| TABLES. | L | 07B2 |
| TABLE_ADDR. | D | 0025 |
| TEST_ARRAY. | D | 0061 |
| TEST_CODE | D | 0029 |
| TEST_COUNT. | D | 0034 |
| TEST_FREQ | D | 0037 |
| TEST_LOW_BYTE | L | 063F |
| TEST_MODE | D | 003B |
| TEST_NEXT | L | 0665 |
| TEST_PORT_3 | L | 0188 |
| TEST_PULSE. | D | 0032 |
| TEST_RESTART. | L | 02D8 |
| TEST_TIME | D | 0035 |
| TEST_TONE | L | 073B |
| TIMER0_INTERUPT | L | 07B0 |
| TIMER1_INTERUPT | L | 0713 |
| TIMER1_OUT. | L | 0754 |
| TONE_COUNT. | D | 001A |
| TONE_TIME | I | 0001 |
| TOP_FREQ. | D | 0042 |
| VALIDATE_FREQ | L | 05D1 |
| VALIDATE_PULSE. | L | 055E |
| VF1 | L | 05F3 |
| VF10. | L | 0609 |
| VF20. | L | 060D |
| VF5 | L | 0605 |
| VP1 | L | 05B3 |
| VP10. | L | 05C9 |
| VP20. | L | 05CD |
| VP5 | L | 05C5 |
| VPF1. | L | 0580 |
| VPF10 | L | 0596 |
| VPF20 | L | 059A |
| VPF5. | L | 0592 |
| XFIND_NEXT_FREQ | L | 02D5 |
| XLOW_POWER. | L | 01E9 |
| XNR1. | L | 0159 |
| XTABLE1 | L | 0945 |
| XTABLE10. | L | 09B5 |
| XTABLE11. | L | 09C5 |
| XTABLE12. | L | 09D5 |
| XTABLE13. | L | 09E5 |
| XTABLE14. | L | 09F5 |
| XTABLE17. | L | 0A05 |

What is claimed is:

1. An electronic tuner for a musical instrument having a plurality of strings wherein each of said strings is vibratable at a different fundamental frequency and at integer multiple harmonic frequencies of said fundamental frequency, means for transducing vibrations on each of said strings into an electrical analog signal, and means for tensioning each of said strings to tune said fundamental frequency to an in-tune frequency associated with each of said strings, said electronic tuner comprising:

a waveshaping circuit having an input to which said analog signal is applied and an output at which a pulse train signal is developed, said pulse train signal having a plurality of successive pulses, each of said pulses having a pulse width, said analog signal being transduced from vibrations on a selected one of said strings;

a central processing unit programmed to compute a current fundamental frequency on said one of said string as a function of a ratio between a numerical count of said pulses occurring between at least two of said pulses and including one of said two of said pulses and a sum of said pulse width of each of said pulses included in said count wherein said two of said pulses have a longest pulse width of said pulses in said pulse train signal, and further to compute a difference between said current fundamental frequency and said in-tune frequency associated with said selected one of said strings; and a display which displays said difference whereby said selected one of said strings can be tuned to minimize said difference.

2. An electronic tuner as set forth in claim 1 wherein said waveshaping circuit develops each of said pulses to have a leading edge corresponding to a positive slope zero crossing of said analog signal and a trailing edge corresponding to a negative slope zero crossing of said analog signal, said pulse width of one of said pulses extending between said leading edge of one of said pulses and said leading edge of a next successive one of said pulses.

3. An electronic tuner as set forth in claim 2 wherein said waveshaping circuit includes:

a unity gain noninverting first amplifier circuit having an input to which said analog signal is applied and an output;

an inverting second amplifier circuit having an input electrically coupled to said output of said first amplifier circuit and an output; and an inverting high voltage gain third amplifier circuit having an input electrically coupled to said output of said second amplifier and an output at which said pulse train signal is developed.

4. An electronic tuner as set forth in claim 1 wherein said display includes:

A first LED, said first LED being illuminated when said difference is substantially minimized.

5. An electronic tuner as set forth in claim 4 wherein said displaying means further includes:

a pair of second LEDs, one of said second LEDs being illuminated when a magnitude of said difference exceeds a pre-selected magnitude.

6. An electronic tuner as set forth in claim 5 wherein a first one of said second LEDs indicates a negative polarity of said difference and a second one of said LEDs indicates a positive polarity of said difference.

7. An electronic tuner as set forth in claim 5 wherein said displaying means further includes:

a plurality of third LEDs, one of said third LEDs being illuminated when said magnitude of said difference is above a pre-determined increment of said magnitude and less than said pre-selected magnitude.

8. An electronic tuner as set forth in claim 7 wherein said first LED, said second LEDs and said third LEDs are disposed in a linear array, said first LED being disposed at a center of said array, a first one of said second LEDs being disposed at a first end of said array and a second one of said second LEDs being disposed at a second end of said array, an equal number of said third LEDs being disposed intermediate each one of said second LEDs and said first LED.

9. An electronic tuner as set forth in claim 8 wherein said first end of said array corresponds to a negative polarity of said difference and said second end of said array corresponds to a positive polarity of said difference.

10. An electronic tuner as set forth in claim 7 wherein said display further includes:

a plurality of normally open switches, each of said switches being coupled in series with a corresponding one of said third LEDs, each of said first switches represents a corresponding one of said strings, such that closing one of said switches selects said selected one of said strings to be tuned.

11. An electronic tuner as set forth in claim 4 wherein said display further includes:

a plurality of further LEDs;

a plurality of normally open switches, each of said switches being coupled in series with a corresponding one of said further LEDs, each of said switches representing a selected tonal increment from an audible tone heard at said in-tune frequency wherein closing of one of said switches illuminates said corresponding one of said further LEDs and develops a voltage transition across said one of said switches in response to closing thereof, said central processing unit in response to said voltage transition changing said in-tune frequency for said selected one of said strings commensurately with said selected tonal increment.

12. An electronic tuner for a musical instrument having a plurality of strings wherein each of said strings is vibratable at a different fundamental frequency and at integer multiple harmonic frequencies of said fundamental frequency, means for transducing vibrations on each of said strings into an electrical analog signal, and means for tensioning each of said strings to tune said fundamental frequency to an in-tune frequency associated with each of said strings, said electronic tuner comprising:

a waveshaping circuit having an input to which said analog signal is applied and an output at which a pulse train signal is developed, said pulse train signal having a plurality of successive pulses, each of said pulses having a pulse width, said analog signal being transduced from vibrations on a selected one of said strings;

a central processing unit programmed to compute a current fundamental frequency on said one of said string as a function of a ratio between a numerical count of said pulses occurring between at least two of said pulses and including one of said two of said pulses and a sum of said pulse width of each of said pulses included in said count wherein said two of said pulses have a longest pulse width of said pulses in said pulse train signal and further to compute a difference between said current fundamental frequency and said in-tune frequency associated with said selected one of said strings;

a display which displays said difference whereby said selected one of said strings can be tuned to minimize said difference; and a muting circuit which selectively mutes said instrument during tuning of said selected one of said strings.

13. An electronic tuner as set forth in claim 12 wherein said muting means includes:

a normally conductive transistor switch having a source, a drain and a gate, said analog signal being applied to said source and coupled through said switch to said drain; and a biasing circuit to selectively bias said gate to turn said transistor switch off when muting is desired.

14. An electronic tuner as set forth in claim 13 wherein said biasing circuit includes:

a flip-flop having a set input, a reset input and a logical output, said logical output being electrically coupled to said gate, said logical output normally developing a bias voltage to maintain said transistor on; and a normally open first switch coupled to said reset input wherein closing of said first switch develops a voltage transition at said reset input to change a logical state of said bias voltage to turn said transistor off thereby muting said instrument.

15. An electronic tuner as set forth in claim 14 wherein said biasing circuit further includes:

a normally open second switched coupled to said set input wherein closing of said second switch develops a voltage transition at said set input to change said logical state of said bias voltage to turn said transistor on.

16. An electronic tuner as set forth in claim 15 wherein said biasing circuit further includes:

a capacitor electrically coupled between said gate and ground potential to filter switching transients in said bias voltage.

17. An electronic tuner as set forth in claim 15 wherein said biasing circuit further includes:

a pair of filter circuits, each of said filter circuits being coupled to a corresponding one of said source and said drain to eliminate DC spikes and residual DC voltage from said source and said drain.

18. An electronic tuner as set forth in claim 14 wherein said biasing circuit further includes a capacitor coupled to said set input and biased to force a set of said flip-flop on power up of said tuner so that said transistor switch is conductive upon power up.

19. An electronic tuner for a musical instrument having a plurality of strings wherein each of said strings is vibratable at a different fundamental frequency and at integer multiple harmonic frequencies of said fundamental frequency, means for transducing vibrations on each of said strings into an electrical analog signal, and means for tensioning each of said strings to tune said fundamental frequency to an in-tune frequency associated with each of said strings, said electronic tuner comprising:

a waveshaping circuit having an input to which said analog signal is applied and an output at which a pulse train signal is developed, said pulse train signal having a plurality of successive pulses, each of said pulses having a pulse width, said analog signal being transduced from vibrations on a selected one of said strings;

a central processing unit programmed to compute a current fundamental frequency on said one of said string as a function of a ratio between a numerical count of said pulses occurring between at least two of said pulses and including one of said two of said pulses and a sum of said pulse width of each of said pulses included in said count wherein said two of said pulses have a longest pulse width of said pulses in said pulse train signal, and further to compute a difference between said current fundamental frequency and said in-tune frequency associated with said selected one of said strings;

a display which displays said difference whereby said selected one of said strings can be tuned to minimize said difference; and a power supply to provide power to said waveshaping circuit, said central processing unit and said display, said power supply being adapted to receive a battery.

20. An electronic tuner as set forth in claim 19 wherein said power supply includes:

a PNP power supply transistor having an emitter adapted for electrically coupling to a positive terminal of said battery, a collector and a base;

a normally open first switch resistively coupled between said base and ground potential wherein momentary closing of said on switch turns said power supply transistor on;

a NPN control transistor having an emitter adapted to be coupled to ground potential, a collector electrically coupled to said first switch and a base adapted for coupling to a negative terminal of said battery;

a first Zener diode having an anode resistively coupled to said base of said control transistor and a cathode coupled to said collector of said power supply transistor, said collector of said power supply transistor when on developing a first bias voltage, said control transistor saturating response to said power supply transistor being turned on to maintain said power supply transistor on; and a normally open second switch coupled between said base of said control transistor and ground potential, wherein momentary closing of said second switch turns said control transistor off to remove a base bias voltage from said base of said power supply transistor whereby said power supply transistor turns off.

21. An electronic tuner as set forth in claim 20 wherein said power supply further includes:

a voltage regulator responsive to said first bias voltage for developing a well regulated logic level second bias voltage.

22. An electronic tuner as set forth in claim 21 wherein said power supply further includes a low power indicator circuit having a second NPN transistor and a second Zener diode, said second NPN transistor having a collector resistively coupled to said second bias potential, an emitter coupled to ground potential and a base, said Zener diode having a cathode coupled to said first bias potential and an anode resistively coupled to said base of said second NPN transistor, said second NPN transistor being saturated when said battery has sufficient voltage, said second NPN transistor turning off when said battery voltage falls below a reverse breakdown voltage of said second Zener diode, said collector of said second NPN transistor developing a collector voltage substantially equal to said second bias voltage when said second transistor turns off, said computing means in response to said collector voltage being further for developing a further signal, said displaying means being responsive to said further signal for visually indicating low voltage of said battery.

23. An electronic tuner as set forth in claim 21 wherein said power supply further includes:

flip-flop normally set on power up, said flip-flop having a clock input and an inverse logic output, said emitter of said control transistor being electrically coupled to said inverse logic output, said computing means further developing a strobe pulse after a pre-selected time of inactivity in said computing means, said strobe pulse being applied to said clock input causing a change of state of said inverse logic output, said control transistor being turned off in response of said change of state to turn off said power supply.

* * * * *